US007476632B2

(12) United States Patent
Olson et al.

(10) Patent No.: US 7,476,632 B2
(45) Date of Patent: Jan. 13, 2009

(54) FIBROUS NONWOVEN WEB

(75) Inventors: David A. Olson, St. Paul, MN (US); Jonathan H. Alexander, Roseville, MN (US); Michael R. Berrigan, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/295,526

(22) Filed: Nov. 15, 2002

(65) Prior Publication Data

US 2004/0097155 A1 May 20, 2004

(51) Int. Cl.
*D04H 1/54* (2006.01)
*D04H 3/14* (2006.01)
*D04H 5/06* (2006.01)

(52) U.S. Cl. ..... 442/411; 442/334; 442/340; 442/341; 442/344; 442/351; 442/352; 442/356; 442/357; 442/400; 442/401; 442/409

(58) Field of Classification Search ..... 442/334, 442/352, 340, 351, 344, 356, 357, 411, 341, 442/400, 401, 409
See application file for complete search history.

(56) References Cited

U.S. PATENT DOCUMENTS 3,607,588 A 9/1971 Soehngen
3,676,239 A 7/1972 Soehngen
3,738,884 A 6/1973 Soehngen
3,740,302 A 6/1973 Soehngen
3,749,633 A 7/1973 Soehngen
3,819,452 A 6/1974 Soehngen
4,086,381 A 4/1978 Cheshire et al.
4,100,324 A 7/1978 Anderson et al.
4,111,733 A 9/1978 Periers
4,118,531 A 10/1978 Hauser
4,149,550 A 4/1979 Green et al. ..... 131/266
4,267,002 A 5/1981 Sloan et al. ..... 156/276
4,357,379 A 11/1982 Sloan et al. ..... 428/113
4,375,446 A 3/1983 Fujii et al.
4,392,903 A 7/1983 Endo et al. ..... 156/167
4,409,282 A 10/1983 Fujii et al.
4,434,205 A 2/1984 Fujii et al.
4,590,114 A 5/1986 Holtman
4,818,464 A 4/1989 Lau
4,837,067 A 6/1989 Carey, Jr. et al.

(Continued)

FOREIGN PATENT DOCUMENTS

CA 2100133 1/1994

(Continued)

*Primary Examiner*—Norca L Torres-Velazquez
(74) *Attorney, Agent, or Firm*—Kenneth B. Wood

(57) ABSTRACT

New nonwoven fibrous webs are taught which comprise a collected mass of a) directly formed fibers disposed within the web in a C-shaped cross-sectional configuration and b) staple fibers having a crimp of at least 15% dispersed among the directly formed fibers in an amount of at least 5% the weight of the directly formed fibers. The web is lofty but free of macrovoids. Preferably, the web has a filling ratio of at least 50 and a light transmittance variation of about 2% or less. Typically, fibers within the web are bonded together at points of fiber intersection, preferably with autogenous bonds, to provide a compression-resistant matrix. The webs are especially useful as acoustic and thermal insulation.

24 Claims, 9 Drawing Sheets

U.S. PATENT DOCUMENTS

| | | | | |
|---|---|---|---|---|
| 5,270,107 | A | 12/1993 | Gessner | |
| 5,298,694 | A | 3/1994 | Thompson et al. | |
| 5,500,295 | A | 3/1996 | Halm et al. | |
| 5,503,782 | A | 4/1996 | Dyrud et al. | |
| 5,641,555 | A | 6/1997 | Berrigan et al. | 428/152 |
| 5,643,507 | A | 7/1997 | Berrigan et al. | |
| 5,658,640 | A | 8/1997 | Berrigan et al. | |
| 5,658,641 | A | 8/1997 | Berrigan et al. | |
| 5,685,757 | A | 11/1997 | Kirsch et al. | |
| 5,702,801 | A | 12/1997 | Chien | |
| 5,841,081 | A * | 11/1998 | Thompson et al. | 181/286 |
| 6,169,045 | B1 | 1/2001 | Pike et al. | |
| 6,410,138 | B2 | 6/2002 | Mleziva et al. | |
| 6,667,254 | B1 * | 12/2003 | Thompson et al. | 442/351 |

FOREIGN PATENT DOCUMENTS

| | | |
|---|---|---|
| CN | 1090000 A | 7/1994 |
| EP | 0 295 038 | 12/1988 |
| EP | 0 578 107 | 1/1994 |
| GB | 2 063 321 | 6/1981 |
| GB | 2 267 100 | 11/1993 |
| WO | WO 00/66824 | 11/2000 |

* cited by examiner

FIBROUS NONWOVEN WEB

FIELD OF THE INVENTION

This invention relates to fibrous nonwoven webs comprising fibers arranged in a C-shaped configuration (C-shaped when the web is viewed in a longitudinal vertical cross-section).

BACKGROUND OF THE INVENTION

Prior-art workers have used microfibers to create superior acoustic and thermal insulating webs, taking advantage of insulating effects associated with the large surface area of the fine-diameter microfibers. Staple fibers have been blended with the microfibers in this prior work to open the web, thereby increasing the effectiveness of the microfibers and improving the insulating properties of the web (see, for example, U.S. Pat. Nos. 4,118,531 and 5,298,694). The prior-art microfiber-based insulating webs have developed important commercial acceptance and value; but improvement is continually sought, and the present invention makes possible an advance in these webs—e.g., an improvement in insulating properties—as discussed below.

The present invention is also an advance in another nonwoven web technology, which was first developed many years ago, even before development of the just-described insulating webs (see U.S. Pat. Nos. 3,607,588; 3,676,239; 3,738,884; 3,740,302; 3,819,452; and U.K. Patent No. 1,190,639, all issued from a line of patent applications originally filed in 1966). This technology involved the collection of spray-spun filamentary material with a collector consisting of two spaced-apart, contrarotating rolls disposed in the path of the material issuing from the extrusion orifice. The gap between the rolls was substantial, and only portions of the spray-spun filamentary material were deposited directly on the roll surfaces. The remainder of the filamentary material crossed back and forth randomly between the layers of material deposited on the roll surfaces to form a bridging structure connecting the layers together.

An object of this prior-art development was to provide nonwoven fibrous structures in which each of the opposed surfaces of the web consists of a densified layer, with those densified surface layers being connected by an integrally formed core made up of fibrous components bridging the space between the surface layers. A particular use of the technique was to provide pile-like fabrics formed by splitting the collected web lengthwise between and parallel to the surface layers. The dense surface layers, which desirably were collected on smooth-surfaced solid (nonporous) rolls while the fibers were tacky, served as a backing for the fabric, and the cut bridging structure between the surface layers became the "pile," or upstanding fiber portion. In a representative example, the fibers had a diameter of about 24 micrometers.

When observed in a longitudinal vertical cross-section through the described collected web, the fibers exhibited a C-shaped configuration. A segment (or segments) of a representative individual fiber was disposed so as to be generally transverse or perpendicular to the faces of the web (this segment(s) formed the vertical portion of the "C"), and other segments of the fiber connected to the transverse segment(s) lay within the faces of the web (the arms of the "C"). Also, the C shapes were discrete from one another. That is, the fibers were grouped into sheets or subassemblies, each of which had a C-shaped configuration. The discrete C-shaped sheets or subassemblies were spaced apart in the machine direction of the web. That is, the arms of adjacent C-shaped subassemblies overlapped and formed the faces of the web, but the transverse portion of the C's were spaced apart, thus leaving large channels or voids within the collected webs that occupied almost the full height of the web and appeared to extend across the width of the web.

Another prior-art use of fibers in a C-shaped configuration is found in a series of patents issued in the U.S. in 1983-84 (U.S. Pat. Nos. 4,375,446; 4,409,282; and 4,434,205), based on original filings in Japan in 1978-79. These patents teach the collection of meltblown fibers in the "valley-shaped" zone between two separated porous plates or rollers. The collected webs are rather compact (one of the plates is often referred to as a presser plate, though it is stated that compression is not always necessary). A preferred use for the collected webs seems to be as synthetic leather; other described uses are electrical insulators, battery separators, filters, and carpets.

A more recent patent publication, WO 00/66824, published November 2000, also teaches webs with fibers collected in C-shaped configuration. The collected fibers are said to be folded to form loops, with the loops forming "a train of waves spaced along the machine direction, running from edge to edge in the cross direction and extending in the z-direction" (through the thickness of the web). Large channels or voids are pictured running through the width of the web. Either meltspun or meltblown webs are contemplated, and the meltblown webs may be a "coform" type of web; the latter are described with reference to U.S. Pat. No. 4,818,464 as containing other materials such as pulp, superabsorbent particles, cellulose or staple fibers, exemplified as cotton, flax, silk or jute.

The densified, compacted, or channeled webs of the prior art may be adapted to particular uses as described in the patents, though we are unaware of any commercial products that have resulted from these prior-art teachings.

SUMMARY OF THE INVENTION

The present invention provides new fibrous nonwoven webs, which in brief summary, comprise a collected mass of directly formed fibers disposed within the web in a C-shaped configuration, and crimped staple fibers dispersed within the web to give the web loft and uniformity.

By "directly formed fibers" it is meant fibers formed and collected as a web in essentially one operation, e.g., by extruding fibers from a fiber-forming liquid, e.g., molten or dissolved polymer, glass, or the like, and collecting the extruded fibers as a web. Such a method is in contrast with methods in which, for example, extruded fibers are chopped into staple fibers before they are assembled into a web. Meltblown fibers and meltspun fibers, including spunbond fibers and fibers prepared and collected in webs in the manner described in WO 02/055782, published Jul. 18, 2002, are examples of directly formed fibers useful for the present invention.

By "C-shaped configuration," it is meant that the fibers are assembled or organized in the web so that, when the web is viewed in a vertical, longitudinal cross-section, a representative individual directly formed fiber is seen to include a) a segment or segments disposed within the web transversely to the faces of the web (this segment(s) forms the vertical portion of the "C"), and b) other segments (the arms of the "C"), which are connected to the transverse segment(s), are substantially parallel to the opposite faces of the web, and extend from the transverse segment in a direction opposite from the "machine direction" of the web (the direction in which the web moved during formation). The transverse segment(s)

need not be straight or perpendicular to the faces of the web ("faces of the web" means the two large-area exterior surfaces of the collected mass of directly formed fibers), but as will be further explained, can have portions that are slanted or angled toward the web faces. Also, the portions near to the web faces need not be wholly or exactly parallel with the faces, but can approach parallelism. Generally, there is a gradual change in direction of the fibers between a portion that is transverse to the faces and a portion parallel to the faces. Also, not all of the directly formed fibers need be in a C-shaped configuration; instead a portion of a fiber or some of the fibers may be disposed in a random multidirectional pattern; such a pattern may provide a beneficial continuity and isotropy to the web.

It has been found that with crimped staple fibers being dispersed among the directly formed fibers in C-shaped configuration, a desirable loftiness and uniformity is obtained. Different degrees of loftiness may be produced as desired for a particular use of a web of the invention. For example, most often the web will have a filling ratio (the ratio of the volume occupied by the web divided by the volume of the material from which the fibers of the web are formed) of 20 or more. But much higher filling ratios can be obtained. Particular advantages arise when the filling ratio is 50 or more, and filling ratios of 75 or 100 are readily achieved; in preferred webs, we have achieved 150 or 200 or more.

Also, whereas prior-art webs with fibers in a C-shaped configuration appear to have contained large voids, webs of the invention can be free of such macrovoids (voids that have a vertical dimension—i.e., through the thickness of the web—that is at least one-half the thickness of the web and extend through at least a major portion of the width of the web); preferred webs of the invention are essentially free of such macrovoids; more preferably, webs of the invention are essentially free of voids with a vertical dimension one-fourth the thickness of the web, when the web is between 1 and 10 centimeters in thickness, and having a length that is only a minor portion of the width of the web. Instead of such large voids, webs of the invention can have a desirable continuity of fiber structure, which can be demonstrated by a light-transmission-based image analysis technique described herein in connection with the working examples. In this image analysis technique, webs of the invention preferably have a transmission variance of about 2% or less, more preferably about 1% or less, and for the best webs, 0.5% or less.

The lofty character of webs of the invention can be quite lasting, and this lasting character is enhanced by bonding between fibers at points of fiber intersection (bonds need not occur at all fiber intersections) to achieve a compression-resistant matrix within the web. Directly formed fibers may be bonded, or staple fibers may be bonded, or both may be bonded. Preferably the webs are bonded autogenously (bonding without aid of added binder material or embossing pressure).

Webs of the invention preferably exhibit good recovery when compressed. However, while compression recovery is important, compressibility can also be useful, as to allow a web of the invention to be pressed into and fully occupy a space that is being insulated.

Webs of the invention can be prepared using a dual-collector arrangement in which two parallel collectors (such as used by themselves to collect webs from a fiber stream) are spaced apart a small distance, and fibers are collected between the collectors. The collectors rotate or move so that the parallel separated faces of the collector that define the space between the collectors and bound the collected web are both moving in the direction of travel of the fiber stream. Crimped staple fibers are introduced into the stream of directly formed fibers with a force that causes them to become randomly and thoroughly dispersed into the collected web.

It has been found that unique properties, including unique insulating properties, are obtained with the webs. For example, an acoustic insulation web of the present invention having the same composition as a prior-art acoustic insulation web—i.e., consisting of the same fibers in the same sizes and in the same amounts as the prior-art web—can absorb more sound energy than the prior-art web. Such improvements in insulating performance increase the utility of the webs. In addition, insulating (or other) webs of the invention can be provided in more useful forms, for example, in an assortment of thicknesses, including large thicknesses, better adapted to certain insulating needs.

All in all, the invention provides a new web-forming method and technology from which a variety of advances in the nonwovens industry are possible. An example is formation of webs from continuous spunbond or meltspun fibers in greater thicknesses and basis weights than now possible. Present attempts to increase thickness and basis weights of such webs have not been successful, because the first collected layers on the collection surface act as a barrier to the passage of air such that added layers of fibers tend to splay or drift away from the collection surface. Similar effects can occur with fine-diameter microfibers, which collect in a dense air blocking layer. By the present invention, a lofty web structure is collected so that initially deposited layers do not become a barrier that limits subsequent fiber collection, and the prepared web can have good retention of the loft properties, especially when fibers in the web are subjected to autogenous bonding.

DETAILED DESCRIPTION

Figure 1:
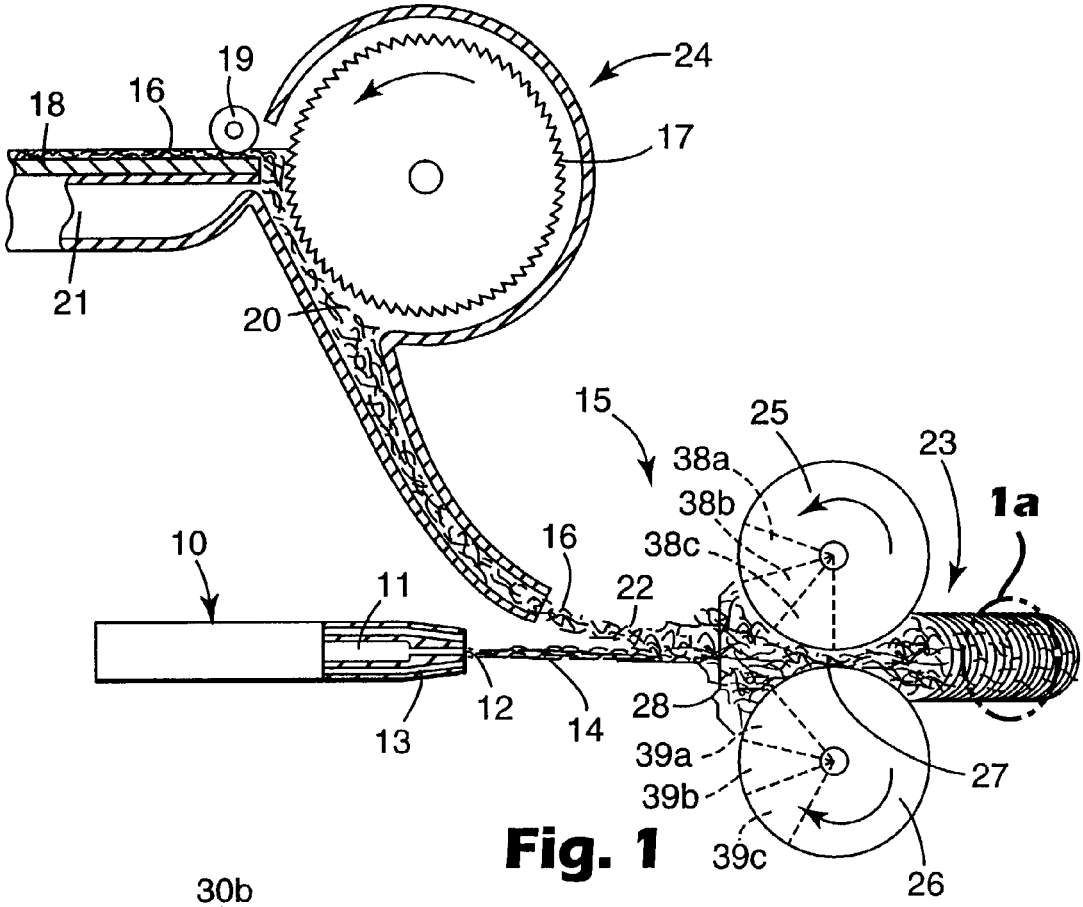
FIG. 1 is a schematic overall diagram of apparatus useful for forming a nonwoven fibrous web of the invention.

FIG. 1 of the drawings shows an illustrative apparatus useful to prepare webs of the invention from meltblown microfibers. The microfiber-blowing portion of the illustrated apparatus can be a conventional structure as taught, for example, in Wente, Van A. "Superfine Thermoplastic Fibers," in Industrial Engineering Chemistry, Vol. 48, pages 1342 et seq (1956), or in Report No. 4364 of the Naval Research Laboratories, published May 25, 1954, entitled "Manufacture of Superfine Organic Fibers" by Wente, V. A.; Boone, C. D.; and Fluharty, E. L. Such a structure includes a die 10 which has an extrusion chamber 11 through which liquefied fiber-forming material is advanced; die orifices 12 arranged in line across the forward end of the die and through which the fiber-forming material is extruded; and cooperating gas orifices 13 through which a gas, typically heated air, is forced at very high velocity. The high-velocity gaseous stream draws out and attenuates the extruded fiber-forming material, whereupon the fiber-forming material solidifies (to varying degrees of solidity) and forms a stream of microfibers 14 during travel to a collector 15, which will be subsequently described.

Crimped staple fibers 16 are introduced into the stream of blown microfibers by the illustrative apparatus 24 of FIG. 1, which in this illustrative case is disposed above the microfiber-blowing apparatus. A web of the staple fibers, typically a loose, nonwoven web such as prepared on a garnet machine or "Rando-Webber," is propelled along a table 18 under a drive roll 19 where the leading edge engages against a lickerin roll 17. The lickerin roll turns in the direction of the arrow and picks off fibers from the leading edge of the web of staple fibers 16, separating the staple fibers from one another. The picked staple fibers are conveyed in an air stream 21 passing through an inclined trough or duct 20 and into the stream 14 of blown microfibers where they become mixed with the blown microfibers.

The mixed stream 22 of microfibers and crimped staple fibers then continues to the collector 15 where the fibers collect as a web 23 of intermixed and entangled fibers. The collector comprises two porous rollers 25 and 26 separated by a gap 27 and rotating in opposite directions so that their facing, web-engaging surfaces are both moving in the direction of the stream 22 and the collected web 23. The stream 22 spreads as it reaches the collector, e.g., because of a lack of confinement of the stream and by the resistance to the stream created by the physical presence of the collector. The height 28 of the stream 22 as it reaches the collector 15 is generally larger than the gap 27. If necessary, an obstacle may be placed within the gap 27 (if only during startup of the operation) to assure that the stream 22 spreads to a height causing it to engage the separated collector rollers 25 and 26.

Figure 1A:
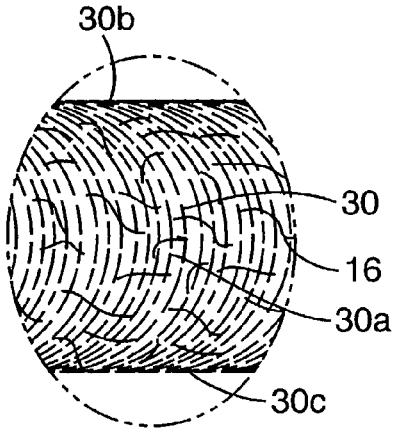
FIGS. 1*a*, 1*b*, and 1*c* are schematic sectional views through representative nonwoven fibrous webs of the invention.
Figure 1B:
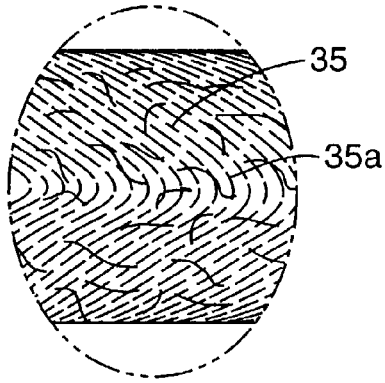
Figure 1C:
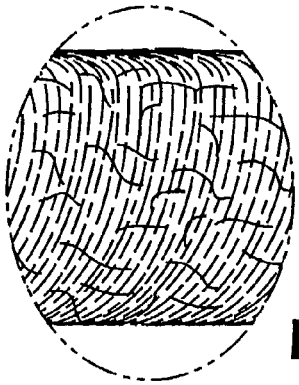

The general organization of the fibers in the web 23 is illustrated by three of many alternative possible arrangements shown in FIGS. 1*a*, 1*b* and 1*c*. As shown there in a schematic and oversimplified manner (for convenience of drawing and illustration), the fibers have a C-shaped configuration when viewed in a lengthwise (or machine-direction) vertical (i.e., transversely through the thickness of the web) cross-section. Fiber 30 represents a single meltblown microfiber or portion thereof (meltblown microfibers are said to be discontinuous, but they are typically very long, so the line 30 typically represents only a portion of a single fiber; for ease of discussion, the line 30 is referred to herein as a fiber). (The numeral 30 does not represent a sheet-like subassembly of fibers as shown in the prior art; rather the C-shaped curves in the drawings simply represent the overall pattern of the web and are used to illustrate the general shape of the directly formed fibers; the lines are broken to emphasize that they simply represent the pattern of the web.) A central segment or length 30*a* of the fiber 30 is transverse to the faces 32 and 33 of the web, and other, end, segments or lengths 30*b* and 30*c* connected to the portion 30*a* are parallel to the faces of the web and typically lie within the surface edge-portion of the web. Typically, segments such as the segments 30*b* and 30*c* form the faces of the web.

In FIG. 1*a* the central segment 30*a* is shown with a large extent that is approximately perpendicular to the faces of the web. That is, although, as is typical, the central segment 30*a* is curved, the curves are gradual and form an angle approaching 90 degrees to the faces; nearly the whole central segment forms an angle of 60 degrees or more to the faces. Such perpendicularity or angularity, e.g., preferably at least 45 degrees, and more preferably at least 60 degrees, is desirable because it improves the resiliency of the web under compression.

FIG. 1*b* shows a different arrangement in which an individual representative fiber 35 has a more shallow or compressed C-shaped configuration. Such a configuration can occur when the gap 27 is large and/or the velocity of the stream 22 as it reaches the collector 15 is large. The central segment 35*a* is shallow or compressed and portions thereof form an angle with the faces of less than 45 degrees, e.g., about 30 degrees over most of their length. Such configurations, although generally less desired, are still useful for some purposes, and are regarded as transverse to the faces herein.

The arrangement illustrated in FIG. 1*c* can occur when the central axis of the stream is displaced from the center of the gap 27 between the collection rollers 25 and 26. Such a skewed C-shaped configuration can produce a web having a web density that varies through the thickness of the web, whereby, for example, the air flow resistance through the web varies for improved acoustical and thermal insulating performance.

Under close examination, the microfibers and crimped staple fibers usually are found to be thoroughly mixed; for example, the web usually is free of clumps of staple fibers, i.e. collections a centimeter or more in diameter of many staple fibers, such as would be obtained if a chopped section of multi-ended tow of crimped filament were unseparated or if staple fibers were balled together prior to introduction into a microfiber stream. The blending of staple fibers into the directly formed fibers has the effect of limiting any premature entanglement of the directly formed fibers before they reach the collector, thus providing greater homogeneity to the product. Also, separation of directly formed fibers by included staple fibers limits any tendency for the directly formed fibers to slide with respect to one another, and thereby allow a permanent deformation of the web, when the web is compressed. (In FIGS. 1*a*-1*c* staple fibers are represented by shorter darker lines; this representation is schematic only, because the staple fibers can have various lengths, including a length greater than the thickness of the web; the staple fibers are typically crimped, which is not illustrated in these figures; and although the staple fibers are typically randomly dispersed, they also can develop some alignment following the C-shaped configuration of the directly formed fibers).

As illustrated in FIG. 1, webs of the invention can be, and often are, more thick than the gap 27 between the collector rollers. The web is within the thickness of the gap 27 when it is between the rollers 25 and 26; but its resilience can cause it to expand in thickness after it passes through the collector. After passing through the collector, the web 23 may be processed in a variety of ways, e.g., passed through an oven to anneal or bond the web, sprayed with an additive such as a finish or bonding material, calendered, cut to size or special shapes, etc. Often the web is wound into a storage roll, and an advantage of the invention is that the web will hold or regain a substantial portion of its thickness when unwound from the roll.

Although FIG. 1 shows the collector 15 as comprising two rollers, other collection apparatus can also be used. For example, a collector belt may be wound around one of the rollers and function as the collector surface. Such a belt can also carry the collected web from the collector to other processing apparatus. A collector that comprises a roller such as one of the rollers 25 and 26 together with a collection belt is a desirable combination. Gas-withdrawal apparatus, e.g., a vacuum apparatus represented by the vacuum chambers 38*a*, 38*b*, and 38*c* for the roller 25 and 39*a*, 39*b*, and 39*c* for roller 26, is desirably positioned behind the collection surface to assist in withdrawing air or other gas from the stream of fibers deposited onto the collection surface. By using a plurality of vacuum chambers the deposition can be further controlled.

Figure 2:
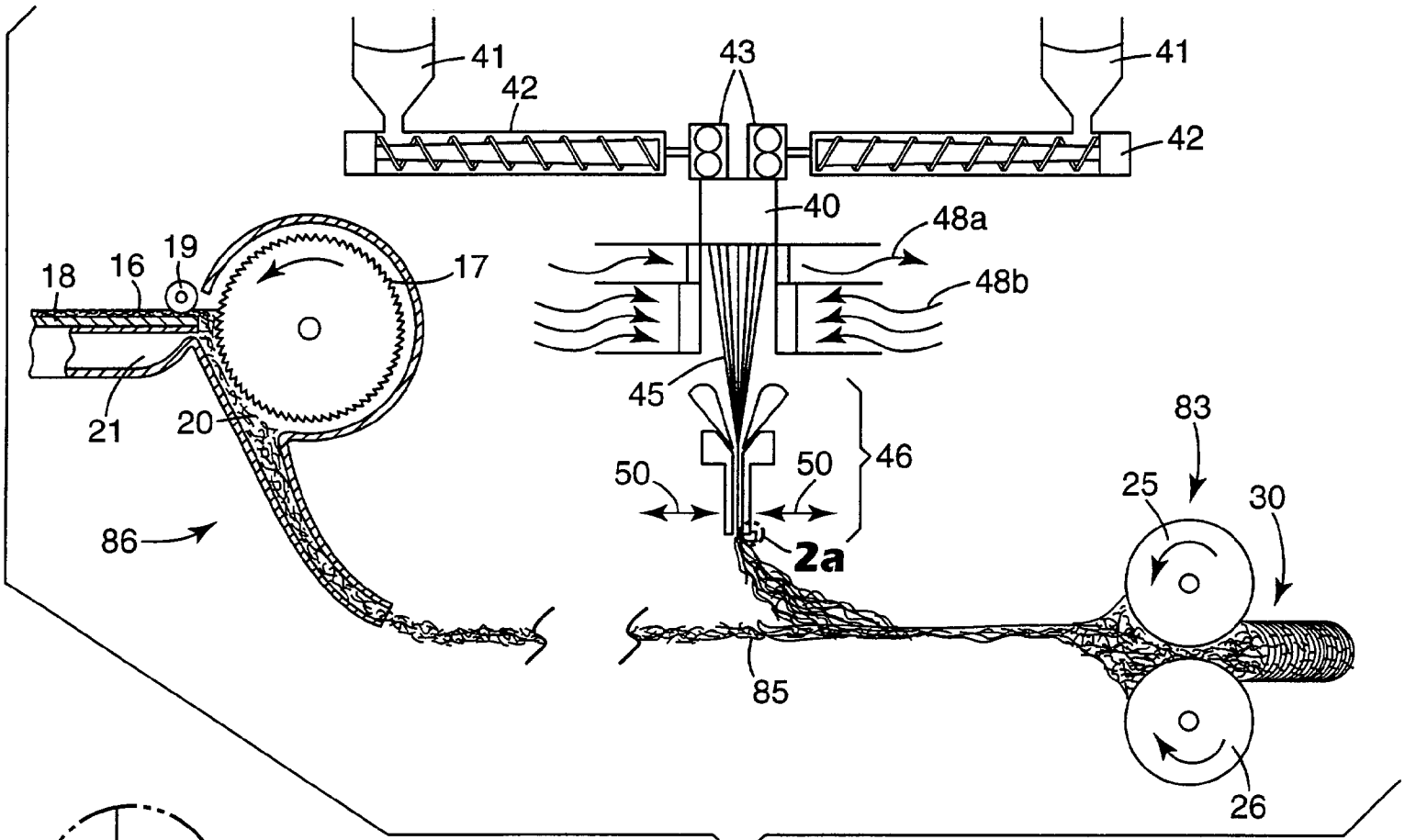
FIG. 2 is a schematic overall diagram of another apparatus for forming a nonwoven fibrous web of the invention.
Figure 2A:
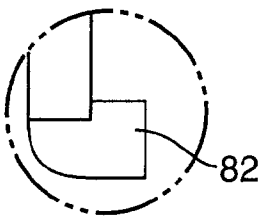
Figure 3:
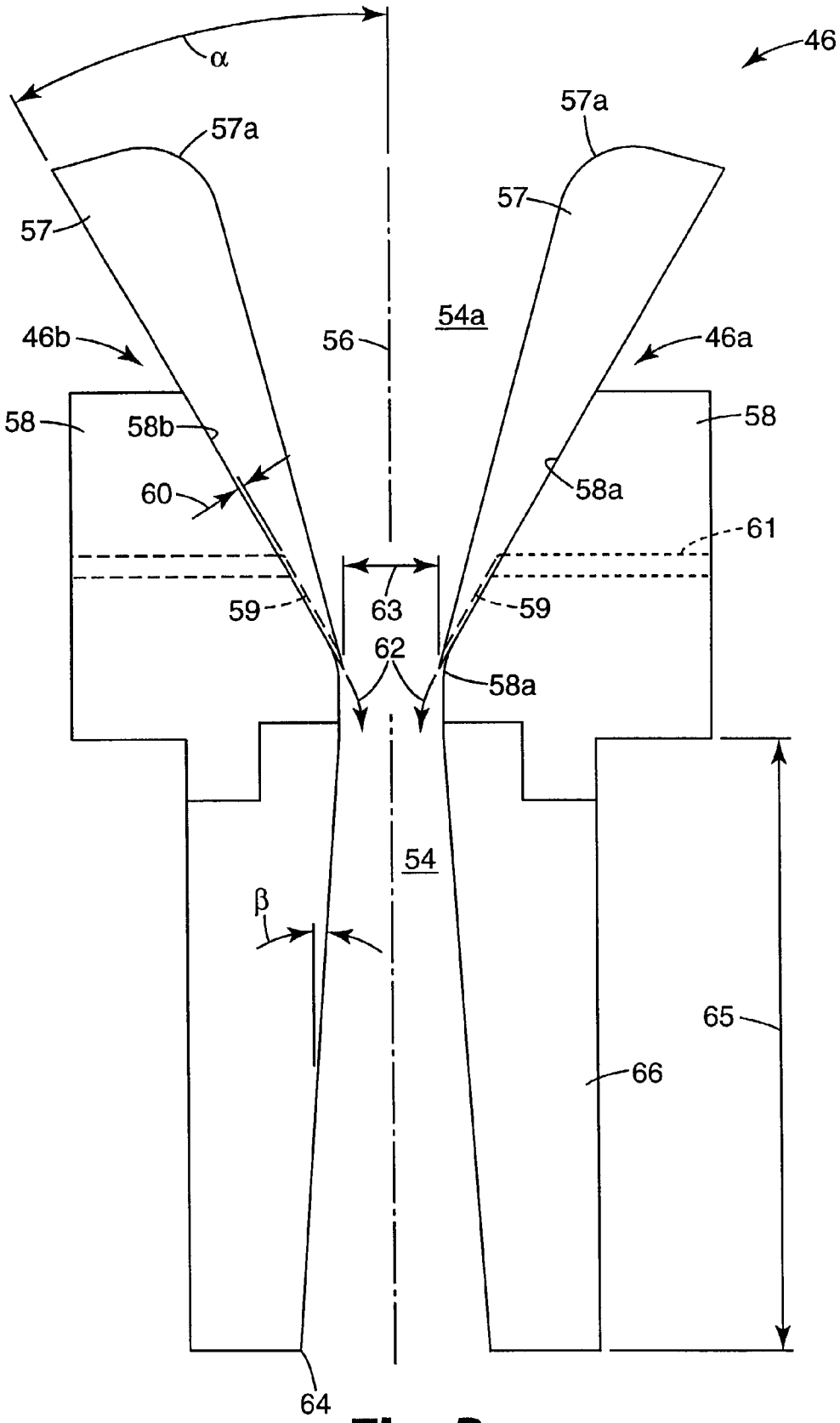
FIG. 3 is an enlarged side view of a processing chamber used in the apparatus of FIG. 2, with mounting means for the chamber not shown.
Figure 4:
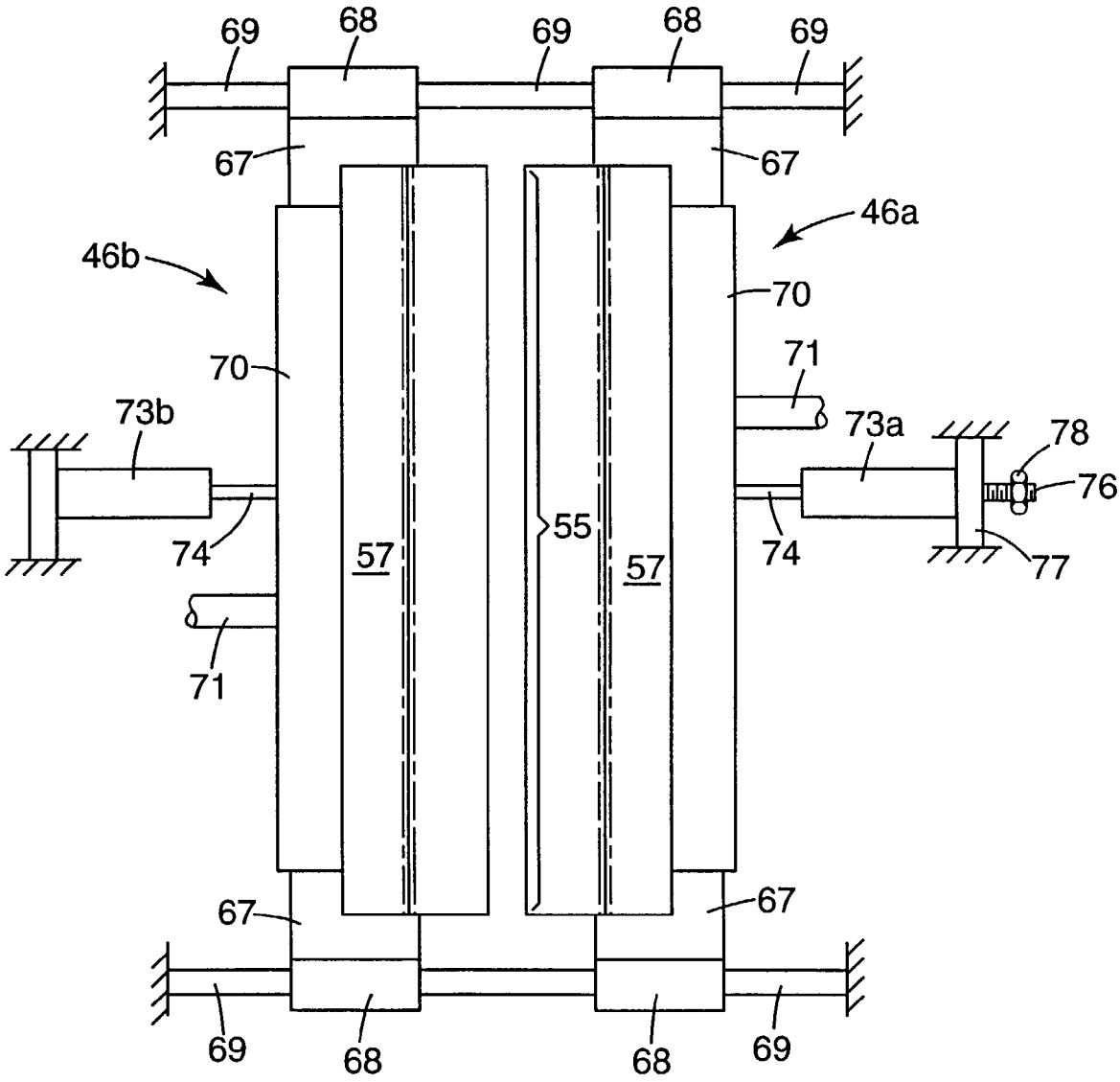
FIG. 4 is a top view, partially schematic, of the processing chamber shown in FIG. 3 together with mounting and other associated apparatus.

FIGS. 2-4 show another apparatus by which webs of the invention can be prepared. In this apparatus the directly formed fibers can be essentially continuous, whereas the meltblown fibers prepared on the apparatus of FIG. 1 are generally regarded as discontinuous. Apparatus as shown in FIGS. 2-4 is described more fully in a published PCT patent application WO 02/055782, published Jul. 18, 2002, which is incorporated herein by reference. The apparatus of FIGS. 2-4 allows practice of a unique fiber-forming method in which, in brief summary, extruded filaments of fiber-forming material are directed through a processing chamber that is defined by two parallel walls, at least one of which is instantaneously movable toward and away from the other wall; preferably both walls are instantaneously movable toward and away from one another. By "instantaneously movable" it is meant that the movement occurs quickly enough that the fiber-forming process is essentially uninterrupted; e.g., there is no need to stop the process and re-start it. If, for example, a nonwoven web is being collected, collection of the web can continue without stopping the collector, and a substantially uniform web is collected.

The wall(s) can be moved by a variety of movement means. In one embodiment the at least one movable wall is resiliently biased toward the other wall; and a biasing force is selected that establishes a dynamic equilibrium between the fluid pressure within the chamber and the biasing force. Thus, the wall can move away from the other wall in response to increases in pressure within the chamber, but it is quickly returned to the equilibrium position by the biasing force upon resumption of the original pressure within the chamber. If extruded filamentary material sticks or accumulates on the walls to cause an increased pressure in the chamber, at least one wall can rapidly move away from the other wall to release the accumulated extrudate, whereupon the pressure is quickly reduced, and the movable wall returns to its original position. Although some brief change in the operating parameters of the process may occur during the movement of the wall(s), no stoppage of the process occurs, but instead fibers continue to be formed and collected.

In a different embodiment the movement means is an oscillator that rapidly oscillates the wall(s) between its original position defining the chamber space, and a second position further from the other wall. Oscillation occurs rapidly, causing essentially no interruption of the fiber-forming process, and any extrudate accumulated in the processing chamber that could plug the chamber is released by the spreading apart of the wall(s).

In the apparatus illustrated in FIG. 2, fiber-forming material is brought to an extrusion head 40—in this illustrative apparatus, by introducing a fiber-forming material into hoppers 41, melting the material in extruders 42, and pumping the molten material into the extrusion head 40 through pumps 43. Although solid polymeric material in pellet or other particulate form is most commonly used and melted to a liquid, pumpable state, other fiber-forming liquids such as polymer solutions could also be used.

The extrusion head 40 may be a conventional spinneret or spin pack, generally including multiple orifices arranged in a regular pattern, e.g., straightline rows. Filaments 45 of fiber-forming liquid are extruded from the extrusion head and conveyed to a processing chamber or attenuator 46. The distance 47 the extruded filaments 45 travel before reaching the attenuator 46 can vary, as can the conditions to which they are exposed. Typically, quenching streams of air or other gas 48 are presented to the extruded filaments by conventional methods and apparatus to reduce the temperature of the extruded filaments 45. Alternatively, the streams of air or other gas may be heated to facilitate drawing of the fibers. There may be one or more streams of air (or other fluid)—e.g., a first air stream 48*a* blown transversely to the filament stream, which may remove undesired gaseous materials or fumes released during extrusion; and a second quenching air stream 48*b* that achieves a major desired temperature reduction. Depending on the process being used or the form of finished product desired, the quenching air may be sufficient to solidify the extruded filaments 45 before they reach the attenuator 46. In other cases the extruded filaments are still in a softened or molten condition when they enter the attenuator. Alternatively, no quenching streams are used; in such a case ambient air or other fluid between the extrusion head 40 and the attenuator 46 may be a medium for any change in the extruded filaments before they enter the attenuator.

The attenuation device of FIG. 2 is further illustrated in FIGS. 3 and 4. FIG. 3 is an enlarged side view of a representative attenuator 46, which comprises two movable halves or sides 46*a* and 46*b* separated so as to define between them the processing chamber 54: the facing surfaces of the sides 46*a* and 46*b* form the walls of the chamber. FIG. 4 is a top and somewhat schematic view at a different scale showing the representative attenuator 46 and some of its mounting and support structure. As seen from the top view in FIG. 4, the processing or attenuation chamber 54 is generally an elongated slot, having a transverse length 55 (transverse to the path of travel of filaments through the attenuator), which can vary depending on the number of filaments being processed.

Although existing as two halves or sides, the attenuator 46 functions as one unitary device and will be first discussed in its combined form. As shown best in FIG. 3, the representative attenuator 46 includes slanted entry walls 57, which define an entrance space or throat 54*a* of the attenuation chamber 54. The entry walls 57 preferably are curved at the entry edge or surface 57*a* to smooth the entry of air streams carrying the extruded filaments 45. The walls 57 are attached to a main body portion 58, and may be provided with a recessed area 59 to establish a gap 60 between the body portion 58 and wall 57. Air may be introduced into the gaps 60 through conduits 61, creating air knives (represented by the arrows 62) that increase the velocity of the filaments traveling through the attenuator, and that also have a further quenching effect on the filaments. The attenuator body 58 is preferably curved at 58*a* to smooth the passage of air from the air knife 62 into the passage 54. The angle ($\alpha$) of the surface 58*b* of the attenuator body can be selected to determine the desired angle at which an air knife impacts a stream of filaments passing through the attenuator. Instead of being near the entry to the chamber, the air knives may be disposed further within the chamber.

The attenuation chamber 54 may have a uniform gap width (the horizontal distance 63 on the page of FIG. 3 between the two attenuator sides is herein called the gap width) over its longitudinal length through the attenuator (the dimension along a longitudinal axis 56 through the attenuation chamber is called the axial length). Alternatively, as illustrated in FIG. 3, the gap width may vary along the length of the attenuator chamber. In all these cases, the walls defining the attenuation chamber are regarded as parallel herein, because the deviation from exact parallelism is relatively slight.

As illustrated in FIG. 4, the two sides 46*a* and 46*b* of the representative attenuator 46 are each supported through mounting blocks 67 attached to linear bearings 68 that slide on rods 69. The bearing 68 has a low-friction travel on the rod through means such as axially extending rows of ball-bearings disposed radially around the rod, whereby the sides 46*a* and 46*b* can readily move toward and away from one another. The mounting blocks 67 are attached to the attenuator body 58 and a housing 70 through which air from a supply pipe 71 is distributed to the conduits 61 and air knives 62.

In this illustrative embodiment, air cylinders 73*a* and 73*b* are connected, respectively, to the attenuator sides 46*a* and 46*b* through connecting rods 74 and apply a clamping force pressing the attenuator sides 46*a* and 46*b* toward one another. The clamping force is chosen in conjunction with the other operating parameters so as to balance the pressure existing within the attenuation chamber 54. In other words, the clamping force and the force acting internally within the attenuation chamber to press the attenuator sides apart as a result of the gaseous pressure within the attenuator are in balance or equilibrium under preferred operating conditions. Filamentary material can be extruded, passed through the attenuator and collected as finished fibers while the attenuator parts remain in their established equilibrium or steady-state position and the attenuation chamber or passage 54 remains at its established equilibrium or steady-state gap width.

During operation of the representative apparatus illustrated in FIGS. 2-4, movement of the attenuator sides or chamber walls generally occurs only when there is a perturbation of the system. Such a perturbation may occur when a filament being processed breaks or tangles with another filament or fiber. Such breaks or tangles are often accompanied by an increase in pressure within the attenuation chamber 54, e.g., because the forward end of the filament coming from the extrusion head or the tangle is enlarged and creates a localized blockage of the chamber 54. The increased pressure can be sufficient to force the attenuator sides or chamber walls 46*a* and 46*b* to move away from one another. Upon this movement of the chamber walls the end of the incoming filament or the tangle can pass through the attenuator, whereupon the pressure in the attenuation chamber 54 returns to its steady-state value before the perturbation, and the clamping pressure exerted by the air cylinders 73 returns the attenuator sides to their steady-state position.

Other clamping means than the air cylinder may be used, such as a spring(s), deformation of an elastic material, or cams; but the air cylinder offers a desired control and variability. In another useful apparatus of the invention, one or both of the attenuator sides or chamber walls is driven in an oscillating pattern, e.g., by a servomechanical, vibratory or ultrasonic driving device. The rate of oscillation can vary within wide ranges, including, for example, at least rates of 5,000 cycles per minute to 60,000 cycles per second. In still another variation, the movement means for both separating the walls and returning them to their steady-state position takes the form simply of a difference between the fluid pressure within the processing chamber and the ambient pressure acting on the exterior of the chamber walls.

In sum, besides being instantaneously movable and in some cases "floating," the wall(s) of the processing chamber are also generally subject to means for causing them to move in a desired way. The walls can be thought of as generally connected, e.g., physically or operationally, to means for causing a desired movement of the walls. The movement means may be any feature of the processing chamber or associated apparatus, or an operating condition, or a combination thereof that causes the intended movement of the movable chamber walls—movement apart, e.g., to prevent or alleviate a perturbation in the fiber-forming process, and movement together, e.g., to establish or return the chamber to steady-state operation.

Although use of an attenuator with movable walls as described can be advantageous, the invention can also be practiced using an attenuator with fixed walls. Whether the walls are fixed or movable, the collected fibers, e.g., the filaments 45 passing through the attenuator 46, are generally continuous in nature, with only isolated interruptions. For purposes herein, fibers prepared on apparatus as shown in FIGS. 2-4, whether the walls are fixed or not, are called "meltspun" fibers. An advantage of the present invention is that such continuous meltspun fibers can be collected in a thick lastingly lofty web.

Quite often, the meltspun fibers passed through an attenuator are molecularly oriented, i.e., the fibers comprise molecules that are aligned lengthwise of the fibers and are locked into that alignment (i.e., are thermally trapped into that alignment, e.g., by cooling of the fibers while the molecules are aligned). The fibers in a spunbond web are generally of this type. Spunbond webs are generally rather thin because it is difficult to collect the oriented fibers as a thick web. But the present invention provides webs of molecularly oriented directly formed fibers in a C-shaped cross-sectional configuration, which allows the webs to be thick and lofty, and to have good retention of loft when exposed to pressure. Such webs, with their combination of strength, possible microfiber presence, loftiness or low solidity, thickness and compression resistance, are regarded as novel and unique.

Directly formed fibers prepared on apparatus as illustrated in FIGS. 2-4 can also have the advantage of a unique bondability. That is, fibers can be prepared on the apparatus that vary in morphology over their length so as to provide longitudinal segments that differ from one another in softening characteristics during a selected bonding operation (such fibers are described in detail in U.S. patent application Ser. No. 10/151,782, filed May 20, 2002, which is incorporated herein by reference). Some of these longitudinal segments soften under the conditions of the bonding operation, i.e., are active during the selected bonding operation and become bonded to other fibers of the web; and others of the segments are passive during the bonding operation. By "uniform diameter" it is meant that the fibers have essentially the same diameter (varying by 10 percent or less) over a significant length (i.e., 5 centimeters or more) within which there can be and typically is variation in morphology. Preferably, the active longitudinal segments soften sufficiently under useful bonding conditions, e.g., at a temperature low enough, that the web can be autogenously bonded.

In addition to variation in morphology along the length of a fiber, there can be variation in morphology between fibers of a fibrous web of the invention. For example, some fibers can be of larger diameter than others as a result of experiencing less orientation in the turbulent field. Larger-diameter fibers often have a less-ordered morphology, and may participate (i.e., be active) in bonding operations to a different extent than smaller-diameter fibers, which often have a more highly developed morphology. The majority of bonds in a fibrous web of the invention may involve such larger-diameter fibers, which often, though not necessarily, themselves vary in morphology. But longitudinal segments of less-ordered morphology (and therefore lower softening temperature) occurring within a smaller-diameter varied-morphology fiber preferably also participate in bonding of the web.

The fiber stream 81 that exits from the attenuator 46 can be blended with crimped staple fibers and collected on a dual-collector apparatus. In the approach illustrated in FIG. 2, the fiber stream 81 is redirected, e.g., through use of a curved Coanda-type surface 82 at the exit of the attenuator. Such a redirection can be convenient for presenting the fiber stream to a dual-collector apparatus 83 and blending crimped staple fibers with the directly prepared fibers exiting the attenuator. An air stream 85 in which crimped staple fibers 16 are entrained can be generated with apparatus 86, similar to that of the apparatus 24 pictured in FIG. 1.

A great variation in apparatus is possible. For example, the fiber-forming apparatus 80 pictured in FIG. 5 uses one extruder 42 instead of two, and omits quenching streams 48. Also, the apparatus that forms directly formed fibers and the apparatus that introduces crimped staple fibers can be oriented at different angles and in different relative positions than those illustrated.

Figure 6A:
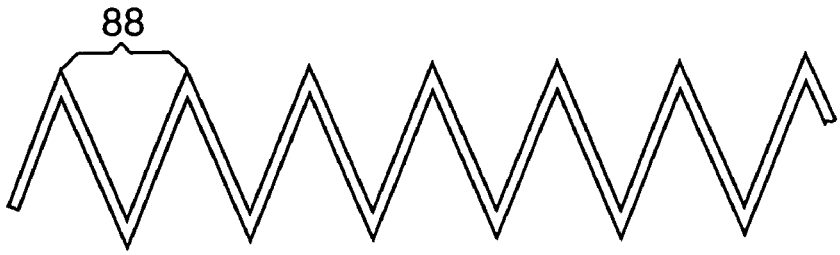
FIGS. 6*a*, 6*b*, and 6*c* are schematic side elevation views of representative crimped staple fibers useful in practicing the invention.
Figure 6B:
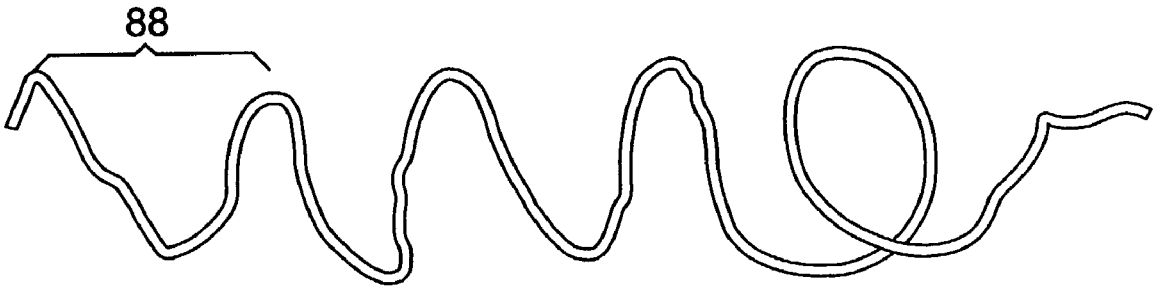
Figure 6C:
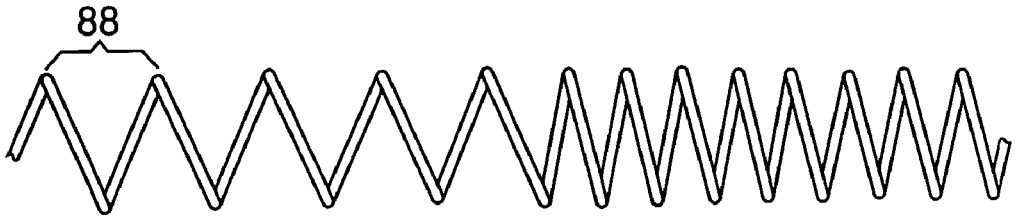

Crimped staple fibers, i.e. having a wavy, curly, or jagged character along their length, are beneficially used in the invention because of the improved web properties they provide as described above, including improved loft and uniformity. In addition, crimped staple fibers are conveniently handleable during web formation, they hold their position better in the assembled web, and they improve compression recovery properties. Crimped staple fibers are available in several different forms for use in a web of the invention. Three representative types of known crimped fibers are shown in FIG. 6: FIG. 6*a* shows a generally planar, regularly crimped fiber such as prepared by crimping the fibers with a sawtooth gear; FIG. 6*b* shows a randomly crimped (random as to the plane in which an undulation occurs and as to the spacing and amplitude of the crimp) such as prepared in a stuffing box; and FIG. 6*c* shows a helically crimped fiber such as prepared by the so-called "Agilon" process. Three-dimensional fibers as shown in FIGS. 6*b* and 6*c* generally encourage greater loftiness in a web of the invention. However, good webs of the invention can be produced from fibers having any of the known types of crimp.

The number of crimps i.e. complete waves or cycles as represented by the structure 88 in FIGS. 6*a, b*, and *c*, per unit of length can vary rather widely in crimped fibers useful in the invention. In general the greater the number of crimps per centimeter (measured by placing a sample fiber between two glass plates, counting the number of complete waves or cycles over a 3-centimeter span, and then dividing that number by 3), the greater the loft of the web. However, larger-diameter fibers will produce an equally lofty web with fewer crimps per unit of length than a smaller-diameter fiber.

Processability on a lickerin roll is usually easier with smaller-diameter fibers having higher numbers of crimps per unit of length. Crimped staple fibers used in the invention will generally average more than about one-half crimp per centimeter, and since the staple fibers will seldom exceed 40 decitex, we prefer fibers that have a crimp count of at least about 2 crimps per centimeter.

Crimped fibers also vary in the amplitude or depth of their crimp. Although amplitude of crimp is difficult to uniformly characterize in numerical values because of the random nature of many fibers, an indication of amplitude is given by percent crimp. The latter quantity is defined as the difference between the uncrimped length of the fiber (measured after fully straightening a sample fiber) and the crimped length (measured by suspending the sample fiber with a weight attached to one end equal to 2 milligrams per decitex of the fiber, which straightens the large-radius bends of the fiber) divided by the crimped length and multiplied by 100. Crimped staple fibers used in the present invention generally exhibit an average percent crimp of at least about 15 percent, and preferably at least about 20 percent. To minimize processing difficulties on a lickerin roll with fibers as shown in FIGS. 6*a* and 6*b* the percent crimp is preferably less than about 50 percent; but processing on a lickerin roll of helically crimped fibers as shown in FIG. 6*c* is best performed if the percent crimp is greater than 50 percent.

The staple fibers should, as a minimum, have an average length sufficient to include at least one complete crimp and preferably at least three or four crimps. When using equipment such as a lickerin roll, the staple fibers should average between about 2 and 15 centimeters in length. Preferably, the staple fibers are less than about 7-10 centimeters in length.

The finer the crimped staple fibers, the greater the insulating efficiency of a composite web, but the web will generally be more easily compressed when the crimped staple fibers are of a low denier. Most often, the staple fibers will have sizes of at least 3 decitex and preferably at least 6 decitex, which correspond approximately to diameters of about 15 and 25 micrometers, respectively.

The amount of crimped staple fibers included or blended with directly formed fibers in a composite web of the invention will depend, among other things, upon the particular use to be made of the web. Generally crimped staple fibers will be present in an amount equal to at least 5 percent of the weight of the directly formed fibers. More typically, the crimped staple fibers will be present in an amount at least 10 percent, and preferably at least 20 percent, of the weight of the directly formed fibers. On the other hand, to achieve good insulating value, especially in the desired low thickness, directly formed fibers will generally account for at least 25, and preferably at least 50 weight-percent of the blend. For purposes other than sound energy dissipation or thermal insulation, microfibers may provide a useful function at lower amounts, though generally they will account for at least 10 weight-percent of the blend.

The fibers may be in different degrees of solidity or tackiness when reaching the collection surface. For most uses of the invention, the fibers are sufficiently solid that they retain their fibrous character upon collection and leave a porous surface. The nature of the surface of a web of the invention can be similar to that of other nonwoven fibrous webs, varying from quite open and porous to differing degrees of consolidation and reduced porosity.

The insulating quality of fibers in a web of the invention is generally independent of the material from which they are formed, and fibers useful in the invention may be formed from nearly any fiber-forming material. Representative polymers for forming meltblown microfibers include polypropylene, polyethylene, polyethylene terephthalate, polyamides, and other polymers as known in the art. Those materials are also useful to form other directly formed fibers such as meltspun fibers. Useful polymers for forming fibers from solution include polyvinyl chloride, acrylics, and acrylic copolymers, polystyrene, and polysulfone. Inorganic materials such as glass also form useful fibers, including microfibers. Many different materials are useful for forming synthetic crimped staple fibers, which are preferred; but naturally occurring staple fibers may also be used if they are crimped. Polyester crimped staple fibers are readily available and provide useful properties. Other useful staple fibers include acrylics, polyolefins, polyamides, rayons, acetates, etc.

If fibers in a web of the invention (either directly formed fibers or staple fibers) are to be bonded, self-bonding forms of those fibers may be used. Typically, such fibers bond upon exposure to heat by softening of a part or all of the fiber. Sometimes fibers self-bond upon collection, e.g., because the fibers have retained sufficient heat to be in a soft condition upon collection. In other cases, webs are passed through an oven after collection, where the bonding fibers are heated to their bonding condition (other beneficial changes can occur in the oven, such as annealing of some or all of the fibers in the web). Instead of using self-bonding fibers, an additive bonding agent may be incorporated in the web, for example, by spraying a liquid agent or dropping a solid, particulate or fibrous agent.

Either directly formed fibers or staple fibers in a web of the invention may be bicomponent fibers (comprising two or more separate components, each of which extends longitudinally along the fiber through a cross-sectional area of the fiber). One utility of bicomponent fibers is to provide bonding, e.g., because one component softens at a temperature lower than another component and forms a bond while the other component retains the fibrous structure of the fiber.

Another form of bondable fiber, also having the advantage, among others, of dimensional stability, is taught in International Patent Application No. WO 02/46504 A1, published Jun. 13, 2002, which is incorporated herein by reference. These directly formed fibers, which are preferably meltblown PET fibers, are characterized by a morphology that appears unique in such fibers. Specifically, the fibers exhibit a chain-extended crystalline molecular portion (sometimes referred to as a strain-induced crystalline (SIC) portion), a non-chain-extended (NCE) crystalline molecular portion, and an amorphous portion. It is believed that the chain-extended crystalline portion in these new meltblown PET fibers provides unique, desirable physical properties such as strength and dimensional stability; and the amorphous portion in these new fibers provides fiber-to-fiber bonding: an assembly of the new fibers collected at the end of the meltblowing process may be coherent and handleable, and it can be simply passed through an oven to achieve further adhesion or bonding of fibers at points of fiber intersection, thereby forming a strong coherent and handleable web.

The unique morphology of the described meltblown PET fibers can be detected in unique characteristics, such as those revealed by differential scanning calorimetry (DSC). A DSC plot for the described PET fibers shows the presence of molecular portions of different melting point, manifested as two melting-point peaks on the DSC plot ("peak" means that portion of a heating curve that is attributable to a single process, e.g., melting of a specific molecular portion of the fiber such as the chain-extended portion; DSC plots of the described PET fibers show two peaks, though the peaks may be sufficiently close to one another that one peak is manifested as a shoulder on one of the curve portions that define the other peak). One peak is understood to be for the non-chain-extended portion (NCE), or less-ordered, molecular fraction, and the other peak is understood to be for the chain-extended, or SIC, molecular fraction. The latter peak occurs at a higher temperature than the first peak, which is indicative of the higher melting temperature of the chain-extended, or SIC, fraction.

An amorphous molecular portion generally remains part of the described PET fiber, and can provide autogenous bonding (bonding without aid of added binder material or embossing pressure) of fibers at points of fiber intersection. This does not mean bonding at all points of fiber intersection; the term bonding herein means sufficient bonding (i.e., adhesion between fibers usually involving some coalescence of polymeric material between contacting fibers but not necessarily a significant flowing of material) to form a web that coheres and can be lifted from a carrier web as a self-sustaining mass. The degree of bonding depends on the particular conditions of the process, such as distance from die to collector, processing temperature of molten polymer, temperature of attenuating air, etc. Further bonding beyond what may be achieved on the collector is often desired, and can be simply obtained by passing the collected web through an oven; calendering or embossing is not required but may be used to achieve particular effects.

Webs as described in the cited application WO 02/46504 are prepared by a new meltblowing method taught in that publication. The new method comprises the steps of extruding molten PET polymer through the orifices of a meltblowing die into a high-velocity gaseous stream that attenuates the extruded polymer into meltblown fibers, and collecting the prepared fibers, these steps being briefly characterized in that the extruded molten PET polymer has a processing temperature less than about 295° C., and the high-velocity gaseous stream has a temperature less than the molten PET polymer and a velocity greater than about 100 meters per second. Preferably, the PET polymer has an intrinsic viscosity of about 0.60 or less.

Interesting webs can be prepared from autogenously bonded directly formed fibers in a C-shaped configuration even if the webs do not contain staple fibers. For example, the webs can develop good loft in the C-shaped configuration, and that loft can be given good resilience by autogenous bonding of the fibers. Most often, the webs are autogenously bonded after collection, e.g., by passage through an oven.

The finer the fibers in a web of the invention, including both directly formed fibers and any other fibers in the web, the better the sound energy dissipation and thermal resistance. Directly formed fibers averaging less than 10 or 15 micrometers in geometric diameter (see the test later herein) are especially useful for many insulation purposes. Fibers of that size are regarded as "microfibers" herein. Directly formed fibers of larger sizes, e.g., 20 micrometers in average geometric diameter or even larger, may be used.

For most uses, webs of the invention preferably have a density of less than 100 kilograms per cubic meter, though preferably more than 2 kg/m$^3$. For webs used as sound insulation, the acoustical specific airflow resistance of the webs should be at least 100 mks rayl. Sound insulation and thermal insulation webs generally have a bulk density of 50 kilograms per cubic meter or less, and preferably of 25 kilograms per cubic meter or less, and are preferably at least 0.5 centimeter thick, and more preferably 1 or 2 centimeters thick depending on the particular application of the webs.

In general, webs of the invention can be supplied in a wide variety of thicknesses depending on the particular use to be made of the web. We have prepared webs of quite large thicknesses, e.g., thicknesses of 5, 10 and even 20 centimeters or more.

Fibrous webs of the invention may include minor amounts of other ingredients in addition to the directly formed fibers and crimped staple fibers. For example, fiber finishes may be sprayed onto a web to improve the hand and feel of the web. Or solid particles (including wood pulp or other uncrimped staple fibers) may be included (see Braun, U.S. Pat. No. 3,971,373 for methods of inclusion) to add features provided by such particles. Solid materials added to the web generally lie in the interstices of the fiber structure formed by the directly formed fibers and crimped staple fibers, and are included in amounts that do not interrupt or take away the coherency or integrity of the fiber structure. The weight of the fiber structure minus additives is known as the "basis weight." This "basis weight" fiber structure, formed of directly formed fibers and crimped staple fibers, exhibits the resilient loftiness of a non-additive web of the invention. Filling ratio of this "basis weight" fiber structure may be determined by following the process conditions used to prepare the additive-included web except for omitting introduction of the additives and measuring the filling ratio of the resulting fiber structure.

Additives, such as dyes and fillers, may also be added to webs of the invention by introducing them to the fiber-forming liquid of the directly formed fibers or crimped staple fibers. A sheet (e.g., a fabric or film) may be laminated (by added adhesives, thermal bonding, sewing, etc.) to the fibrous web to strengthen the web, to provide another function, e.g., as a fluid barrier, to improve handleability, etc. In addition, the web may be processed after formation, as by quilting it to improve its handling characteristics.

Webs of the invention have been found to offer improved sound and thermal insulation properties. Without being bound by any theory of explanation, it is believed that the webs of the invention are capable of improved sound insulation because of the web structure and tortuous path through the construction. At the same time, the webs occupy a large volume, as represented by large filling ratios, per unit of weight, which gives the webs good efficiency, e.g., in acoustic and thermal applications.

EXAMPLES

The invention will be further illustrated by working examples set out below. Test methods used to evaluate the webs include the following:

Average Geometric Fiber Diameter

The average geometric fiber diameter of fibers that comprise webs of the invention was determined by image analysis of SEM photomicrographs of a web specimen ("geometric diameter" herein means a measurement obtained by direct observation of the physical dimension of a fiber, as opposed, for example, to indirect measurements such as those that give an "effective fiber diameter"). Small clumps of fibers were separated from the web being tested and mounted on an electron microscope stub. The fibers were then sputter coated with approximately 100 Angstroms of gold/palladium. The sputter coating was done using a DENTON Vacuum Desk II cold sputter apparatus (DENTON Vacuum, LLC, 1259 North Church Street, Moorestown, N.J., 08057, USA), with an argon plasma having a current of 30 milliamps at a chamber pressure of 100 millitorr. Two 30-second depositions under these conditions were used. The coated samples were then inserted into a JEOL Model 840 scanning electron microscope (JEOL USA, 11 Dearborn Road, Peabody, Mass., 01960, USA) and were imaged using a beam energy of 10 KeV, a working distance of approximately 48 mm, and at 0° sample tilt. Electronic images taken at 750× magnification were used to measure fiber diameters. The electronic images of the surface view of each sample were analyzed using a personal computer running Scion Image, Release Beta 3b (Scion Corporation, 82 Worman's Mill Court, Suite H, Frederick, Md., 21703, USA). To perform the image analysis, Scion Image was first calibrated to the microscope magnification using the scale bar on the image. Individual fibers were then measured across their width. Only individual fibers (no married or roping fibers) from each image were measured. At least 100 fibers were measured for each sample. The measurements from Scion Image were then imported into Microsoft Excel 97 (Microsoft Corporation, One Microsoft Way, Redmond, Wash., 98052, USA) for statistical analysis. Fiber size is reported as the mean diameter in micrometers for a given count number.

Web Solidity and Filling Ratio

Web solidity was determined by dividing the bulk density of a web specimen by the density of the materials making up the web. Bulk density of a web specimen was determined by first measuring the weight and thickness of a 10-cm-by-10-cm section of web. Thickness of the specimen was evaluated as prescribed in the ASTM D 5736 standard test method, modified by using a mass of 130.6 grams to exert 0.002 lb/in$^2$ (13.8 N/m$^2$) onto the face of each sample. When the size of the sample is limited to something less than the size recommended in ASTM D 5736 the mass on the pressure foot is proportionately reduced to maintain a loading force of 0.002 lb/in$^2$ (13.8 N/m$^2$). The specimens were first preconditioned at 22+/−5° C. and in an atmosphere of 50%+/−5% relative humidity and results reported in centimeters. Dividing the weight of the specimen in grams by the sample area in square centimeters derives the basis weight of the specimen, which is reported in g/cm$^2$. The bulk density of the web is determined by dividing the basis weight by the thickness of the specimen and is reported as g/cm$^3$.

Web solidity is determined by dividing the bulk density of the web by the density, in g/cm$^3$, of the material(s) from which the web was produced. The density of the polymer or polymer components can be measured by standard means if the supplier does not specify material density. Solidity is reported as a dimensionless fraction of the percent solids content of a given specimen and is calculated as follows:

$$S=\rho_{web}/\rho_{material}\times 100\%$$

Where:

$$\rho_{material}=\sum_{i=1}^{n} x_i\times\rho_i$$

$$\rho_{web}=BW/t$$

With:

S—Solidity [=] percent $\rho_{web}$—Web bulk density [=] g/cm$^3$ $\rho_{material}$—Density of material making up the web [=] g/cm$^3$ $\rho_i$—Density of web component i [=]g/cm$^3$ $\chi_i$—Weight fraction of component i in web [=] fraction BW—Web basis weight [=] g/cm$^2$ t—web thickness [=] cm Filling ratio, defined as the volume of a web specimen divided by the volume of the material making up the web, was determined from the solidity by the following:

$$FR=100/S$$

With:

FR—Filling ratio [=] cm$^3$/cm$^3$

Web Recovery

Web recovery, i.e., the capacity of the web to recover a degree of its original thickness after compression, was determined by compressing a web sample to a specified solidity using a compressive constraint, holding the sample at the solidity for a fixed period of time, releasing the compressive constraint, and determining the solidity of the web after a specified recovery period. Samples 10 cm by 10 cm or greater in area were compressed along the thickness, or Z-axis, of the web. The compressive constraint was a 45.7 cm×45.7 cm flat plate with sufficient weight to compress the web to a thickness that correlates with the specified solidity. Spacers were used under the edges of the plate to prevent compression greater than a thickness required for the specified solidity. After a 30-minute period of time the compressive constraint was relieved and the thickness of the recovered sample measured. From the recovered thickness the solidity of the web was determined as described above in the solidity method. Web recovery represents the capacity of a web to recover, after compression, to a resulting solidity or corresponding filling ratio. For many web applications, the lower the web solidity and the greater the filling ratio, both initial and recovered, the better.

Thermal Resistance

Thermal resistance was evaluated as prescribed in ASTM C 518 standard test method using a Thermal Conductivity Instrument, model Rapid-K available from Netzsch Instruments, Inc., Boston, Mass., USA. Thickness was evaluated using ASTM D 5736 standard test method as stated in the section titled "Web Solidity". Thermal conductance, $C_T$, is reported in units of $W/(m^2 \cdot K)$. Thermal resistance is given as Clo, where one Clo is reported as $6.457/C_T$. Clo divided by the sample's basis weight in $Kg/m^2$ (the combined weight of the directly formed fibers and staple fibers) is reported as thermal weight efficiency (TWE).

Acoustical Specific Airflow Resistance

Specific airflow resistance was evaluated as prescribed in ASTM C522 standard test method. The specific airflow resistance of an acoustical insulating material is one of the properties that determine its sound-absorptive and sound-transmitting properties. Values of specific airflow resistance, r, are reported as mks rayl (Pa·s/m). Samples were prepared by die cutting a 5.25-inch-diameter (13.33 cm) circular sample. If edges are slightly compressed from the die cutting operation, edges must be returned to original or natural thickness before testing. The preconditioned samples were placed in a specimen holder at the pre-measured thickness and pressure difference measured over a 100 $cm^2$ face area.

Normal Incidence Sound Absorption Coefficient

Sound absorption of acoustic materials was determined by the test method described in ASTM designation E 1050-98, titled "Impedance and Absorption Using A Tube, Two Microphones and A Digital Frequency Analysis System." The Normal Incidence Sound Absorption Coefficient (NISAC), as described in section 8.5.4 of the method, is calculated using the arithmetical average of the 1/3 octave bands of the sound-absorption coefficient from the 250, 500, 1000 and 2000 hertz octave bands.

Image Analysis Method

The uniformity or continuity of the fiber structure of a web (the large-scale structure or macrostructure of the web) was characterized using image analysis. For the purposes of description the major x-y-z axes of the sample were designated as follows: the machine, or lengthwise direction of the web was designated as lying in the "y-axis," the cross machine or width of the web was designated as lying in the "x-axis" and the thickness of the web was designated as lying in the "z-axis." Web specimens were prepared for image analysis by first cutting a 5.1-centimeter-wide (x-axis) sample approximately 19.0 centimeters along the y-axis or machine direction of the web. The web was cut using a fine razor-edged blade in such a manner as to prevent any fusing or cold-welding of the cut edge. The specimen for analysis was then cut from the sample to a length (y-axis) of approximately 16.5 centimeters.

The sample was then fixed in an adjustable rectangular frame. The specimen was mounted in the opening of the rectangular frame such that the y-z plane of the specimen was exposed to view and the path along the x-axis of the specimen was unobstructed by the frame. Walls of the frame were sufficiently wide so that when the specimen was mounted the top and bottom faces of the specimen could be adhesively anchored to the inner walls of the frame. Ends of the specimen were left to free-float in the frame so that the sidewalls of the frame could be adjusted to bring the specimen to the correct thickness for analysis. After the specimen was brought to the correct thickness, which was dictated by the desired solidity for evaluation, image analysis was used to characterize the web structure of the specimen.

Specimens prepared for image analysis were aligned with an area-wide light source or stage so that light shown through an area of the cross-machine direction (y-z plane) of the specimen. An area-wide multipixel image, rendered from the light transmitted through the specimen, was processed and analyzed by a computer program to characterize the web structure. The web structure was then characterized by an analysis of the intensity of the light transmitted through the web.

The image sensor employed by the camera was a charge-coupled device (CCD). A CCD is composed of a large array of tiny light-sensitive photodiodes, which convert photons (light) into electrons (electrical charge). The brighter the light that hits a single photodiode, the greater the electrical charge that will accumulate at that site. These photodiodes are called pixels (pix for picture and el for element). The image analysis process creates an image of light intensity across the face of the test specimen by mapping the electrical charge at each pixel. The pixel size used to capture the image of the specimen was 3.45 microns by 3.45 microns. The total imaging area of the CCD is a standard half-inch format with 4/3 aspect ratio consisting of an array of 1552 rows of pixels with 2088 pixels per row. Using the magnification listed below, an individual pixel or data point imaged an area of 34 microns by 34 microns on the specimen.

The variation in light intensity from data point to data point along the y-axis was used to determine the standard deviation of the intensity along the strip. The variability over the x-y surface of a sample is determined by analyzing a sufficient number of strips, at varied z-axis positions. When a representative number of strips (at different z-axis positions) are analyzed, so as to sufficiently represent variability of the specimen, then the one z-axis strip with the maximum variability is selected for reporting. The number of analysis strips will depend in large part on the thickness of the sample and variability gradation along the z-axis.

A Polaroid MP-3 copy stand with a light box base was used as the light source or light stage. The light box consisted of four GE 75T10FR 75 watt frosted incandescent lamps mounted 5 cm apart and 18 cm below a 24 cm by 24 cm diffusing glass plate. A Leica DC-300 digital camera from Leica Microsystems AG, CH-9435 Heerbrugg, Switzerland fitted with a Tamron SP 35-80 mm macro-zoom lens from TAMRON USA, Inc. 10 Austin Blvd, Commack, N.Y., was used to capture 16-bit gray scale 2088×1550 pixel images.

The light box-sample-camera orientation for imaging was established by first placing the prepared specimen on the diffusing glass plate of the light box so that light shown through the cross-machine direction (x-axis) of the specimen. The lens of the digital camera was directed at the center of the specimen on a line perpendicular to the surface of the light box diffusing glass plate. The lens was spaced approximately 60 cm away form the specimen. The macro-zoom lens of the camera was adjusted to provide a field of view of about 70 mm×52 mm. The camera was focused on the exposed surface of the specimen with the aperture and illumination adjusted so that 100% transmission caused a camera response of approximately 95% of full scale. These settings were then fixed for the capture of an image, including a background image (the image when no sample was present in the rectangular frame).

The image was then analyzed using APHELION image analysis software from ADCIS S.A, 10 avenue de Garbsen, 14200 Herouville Saint-Clair, France. The analysis consisted of normalizing an image of the specimen by dividing it by the image of the background and then measuring an average transmission profile for a region 5 mm by 65 mm in size. The image analyzer determined the degree of light transmittance for individual sample points having dimensions of 5 mm high (z axis) by 0.034 mm long (y axis).

The average 65-mm-long (y-axis) profile consisted of approximately 1900 sample points, i.e., the test specimen was characterized by tracing a succession of approximately 1900 sample points on the exposed (y-z) surface, along the y-direction of the sample all at the same z-axis position. In this way, the variability of light transmittance from point to point along the y axis of the specimen could be determined for any 5-mm-tall (z axis) section. The measured variability in transmitted light is an indicator of fiber association in a web. Webs with fibers grouped or concentrated together display their anisotropic structure by the degree of variation in light transmittance intensity along a given axis of the web. Transmittance variation is reported as the standard deviation of the population of values of transmittance determined from the trace of a specimen.

Example 1

A web of the present invention was prepared from a blend of blown microfibers and staple fibers using apparatus as generally shown in FIG. 1. The top collection surface 25 of the dual-collector apparatus was a perforated metal drum 20.3 cm in diameter with a perforation open area of 53.7% made up of evenly spaced holes 4.7 mm in diameter. The bottom collection surface 26 was a woven metal belt having a balanced weave construction consisting of a series of alternating single left-hand and right-hand spirals joined together by a cross-rod connector part number: B-72-76-13-16, available from Furnace Belt Company Limited, 2316 Delaware Avenue, Buffalo N.Y., 14216, USA covering a perforated drum 20.3 cm in diameter. The belt was supported on two 20.3-cm-diameter rollers spaced 81.3 cm apart. A vacuum source, located behind both collection surfaces, was drawing a total of 48 $m^3$/min. of air through the voids in the collection surfaces. The 60 degree plenum has an area of 0.12 $m^2$ positioned directly behind the collection surfaces, with about 10 degrees of the collection surface with vacuum covered with collected fibers. The surface speed of both collection surfaces was 140 cm/min. with both forward surfaces turning toward the fiber stream and to the through-gap.

The collection surfaces 25 and 26 were aligned vertically one above the other, with their forward surfaces (the forward rotary surfaces of the drum and the collection belt) aligned along an imaginary plane that was parallel to the face of the microfiber die. The center of the gap 27 between the collectors 25 and 26 was aligned with and parallel to the line of extrusion orifices of the microfiber die 10, and with the fiber stream 14 exiting the die. The gap 27 between collection surfaces was 5.1 cm in height and the distance from the face of the microfiber die to imaginary plane of the collection surfaces was 63.5 cm. The overall width of the collection surfaces from side to side, the dimension perpendicular to the page of the drawings, was 76.2 cm.

The blown microfibers were prepared using polypropylene (Fina type 3960 available from FINA Oil and Chemical Co., Houston, Tex). The microfiber die 10 was 50.8 cm wide and had 10 drilled extrusion orifices per centimeter that were 0.38 mm in diameter. The air slot gap between die tip and the air knife was 0.76 mm, with the die tip protruding out in front of the air knives by 0.254 mm. The polymer throughput was held constant at 9.1 grams per orifice per hour. The extruder melt and die were both set to 300° C. The die air manifold pressure was set to 31.0 kPa and the air temperature was set to approximately 350° C.; the volumetric flow of heated air was 7.05 $m^3$/min. The basis weight of the microfiber component of the collected web was 130 g/$m^2$ and the average geometric fiber diameter was approximately 3.0 micrometers. The microfiber component of the finished web constituted 60 wt % of the total weight of the web.

The crimped staple fibers, blended with the microfiber stream to form the combination web, were polyester staple fibers, type 295 available from KoSa, Charlotte, N.C. The staple fibers had a pentalobal cross-section and were 25.5 micrometers in diameter, 38.1 mm cut length, with approximately 4 crimps per centimeter and a percent crimp of about 31%. The weight of the staple fiber component in the web was approximately 40 wt % of the total web weight. The total basis weight of the combination web was 200 g/$m^2$ with a solidity of 0.46%.

Results of the measurements for basis weight, thickness, staple fiber content, solidity, Filling Ratio (both before compression and after recovery from compression), thermal resistance, Thermal Weight Efficiency, normal incidence sound absorption coefficient, acoustical specific air flow resistance, and Image Analysis (with the solidity of the web set to 1.0%) are reported in Table 1.

Figure 7:
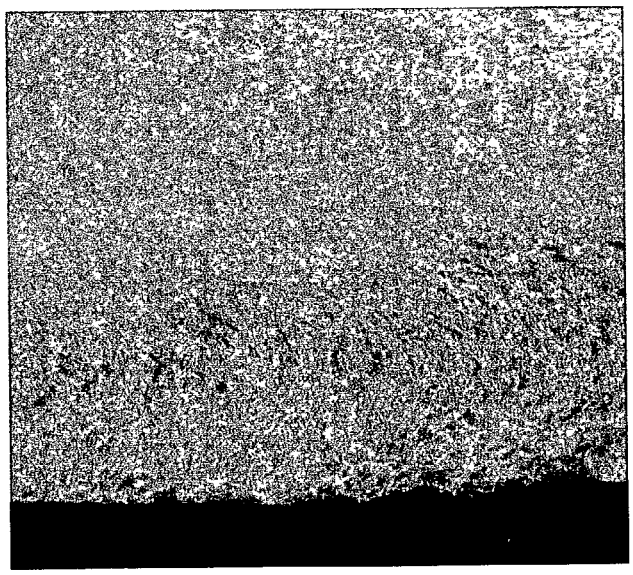
FIG. 7 is a greatly enlarged photograph of a sample web of the invention.

A photograph of a web of Example 1 is shown in FIG. 7. The photograph shows the top surface of the web as well as the cut edge of the web, the cut being a vertical longitudinal cross-section through the web.

Comparative Example 1

Comparative Example 1 was prepared like Example 1 except that the web was collected on a single conventional flat belt collector part number: B-72-76-13-16, available from Furnace Belt Company Limited, 2316 Delaware Avenue, Buffalo N.Y., 14216, USA. The flat vertical collector surface had a vacuum drawing 24 $m^3$/min air through a plenum surface area of 0.278 $m^2$ with the collected fibers covering the entire plenum area. The distance from the die face to the collector surface was 63.5 cm. The total basis weight of the combination web was 205 g/$m^2$.

Web samples were evaluated as described in Example 1 with the results given in Table 1.

Example 2

Example 2 was prepared like Example 1, except the staple fiber composition was 28 wt % of the total weight of the web. The total web weight was 957 g/m$^2$ and the thickness was 19.6 cm. The collector gap was set to 14.0 cm and collection speed was adjusted to collect the specified basis weight. Web samples were evaluated as described in Example 1 with the results given in Table 1.

Comparative Example 2

Comparative Example 2 was prepared like Example 1 except that no staple fiber was used in making the web, which resulted in a finished web of 100% polypropylene blown microfibers. The apparatus was adjusted so that the die-to-collector distance was 25.4 cm with a gap between the collectors set at 1.9 cm and the collector speed set at 45.7 cm/min. The basis weight of the web was 410 g/m2 with a thickness of 2.1 cm. Web samples were evaluated as described in Example 1 with the results given in Table 1.

Example 3

Figure 5:
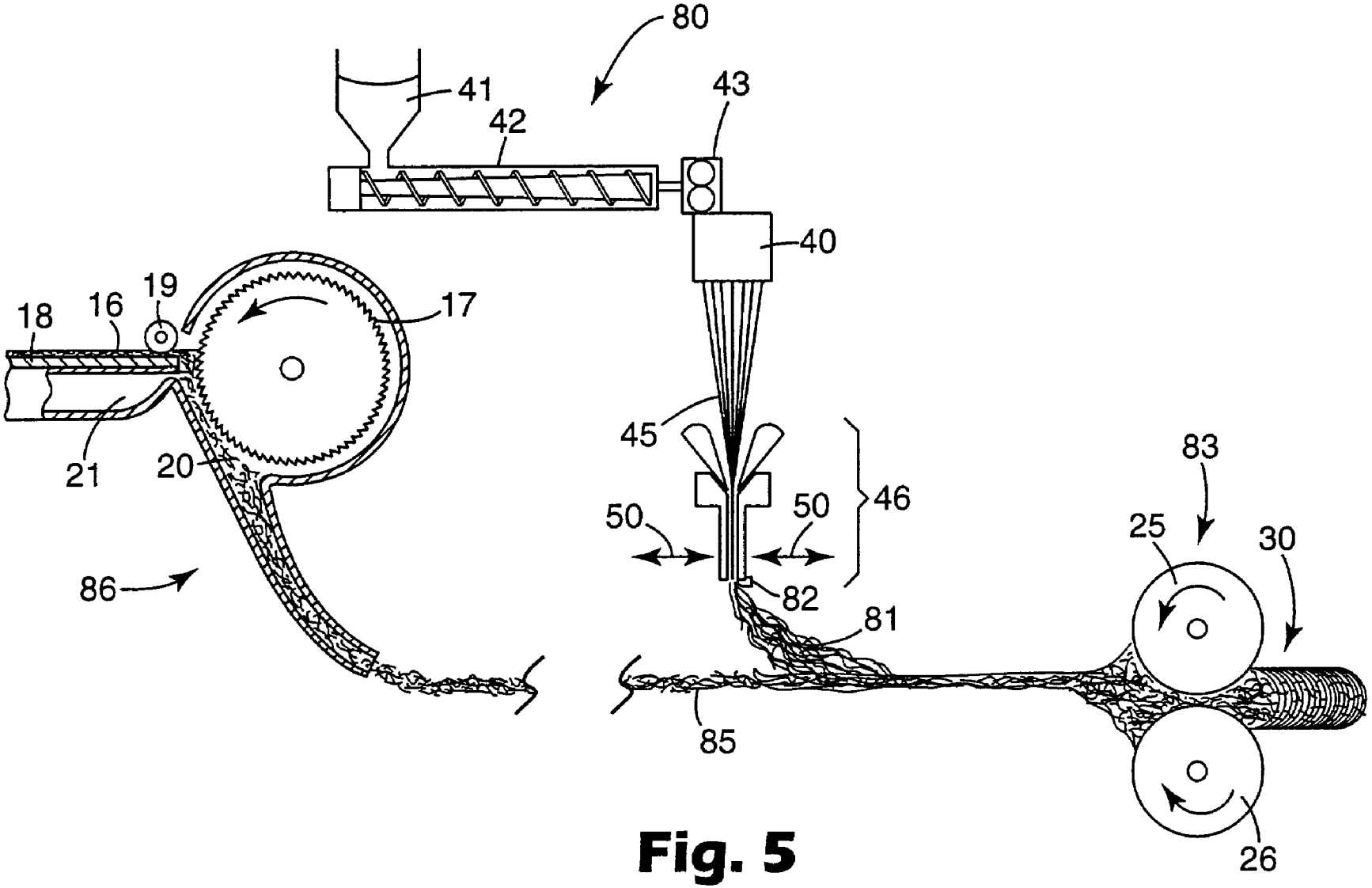
FIG. 5 is a schematic overall diagram of another apparatus for forming a nonwoven fibrous web of the invention.

A web of the invention was prepared from a blend of meltspun fibers and staple fibers, using apparatus as illustrated in FIG. 5. Referring to FIG. 5, PET polymer was charged to hopper 41 and fed to a single screw extruder 42. The extruder conveyed, melted, and delivered the molten polymer at 275° C. to metering pump 43. The metering pump supplied polymer to die 40 at a rate of 4.55 kg/hr. The die 40 was 20.32 cm in length (the dimension perpendicular to the page of drawings) and 7.62 cm in width and was maintained at a temperature of 275° C. The die had 4 rows of extrusion orifices spaced 5.1 mm on center along its length with 21 orifices per row. The bank of orifices was positioned in the bottom face of the die and each orifice was 0.89 mm in diameter and had a length-to-diameter ratio of 3.57 to 1. The die was oriented so that extrudate from the orifices fell vertically from the die to the attenuator 46. The attenuator was positioned 48.1 cm below the die as measured from the die face to the inlet of the attenuator chute. The 12.7 cm wide attenuator was canted counter clockwise 5° from vertical; i.e., the longitudinal axis 56 of the attenuator was inclined towards the apparatus 86. The air knives 62 of the attenuator had a gap thickness 60 of 0.76 mm, and the air knives were supplied with 24° C. air at the rate of 5.78 m$^3$/min. The length of the attenuator chute 65 was 15.24 cm and the opposing wall plates were maintained parallel with a gap of 3.40 mm. A stream director 82 was positioned at the outlet of the chute on the base of the plate towards the collector 83 to aid in directing the meltspun stream towards the collector prior to combination with the staple fiber stream 85.

The staple fiber stream 85 was introduced into the meltspun stream 81 at a point approximately 3.8 cm below the outlet of the of the attenuator chute. The momentum of the merging staple fiber stream, which had a velocity of 1335 meters per minute, further deflected and mixed with the meltspun stream so that the resultant combined stream flowed at an angle of 85° relative to the vertical axis 56 of the attenuator. The staple fibers were thermal bonding sheath/core fibers, type T-254, available from KoSa, Charlotte, N.C. The staple fibers were about 35.5 micrometers in diameter, 38.1 mm cut length, with approximately 2.8 crimps per centimeter and a percent crimp of about 20%. Ambient air into which the staple fibers were entrained was supplied at 8.66 m$^3$/min and delivered to the air chute 20 of the lickerin. The lickerin was 45.7 cm wide with the fiber discharge outlet narrowed to 17.8 cm. The discharge chute from the lickerin was aligned horizontally and approximately 90° to the vertical axis of the attenuator and directed towards the gap 27 of the collector 83. The outlet chute of the lickerin was positioned 30.5 cm from the vertical axis 56 of the attenuator and 3.8 cm below the outlet of the attenuator and was 1.3 meters from the imaginary plane formed by the forward surfaces of the collector.

The collector was of a belt/drum configuration with a collection gap between the drum and belt as described in Example 1. The gap 27 between the drum and belt was maintained at 1.6 cm with the belt and drum surfaces co-rotating at surface speeds of 152 cm/min to draw and form the web mat. The resulting web was 3.19 cm thick and had a basis weight of 544 g/m$^2$ with a composition of 55 wt % staple fiber and 45 wt % meltspun fiber. The fiber size of the melt-spun component was 11.2 μm in diameter as determined by the Average Geometric Fiber Diameter test method. The web was thermally treated in an oven maintained at 160° C. for 5 minutes to cause both the thermal bonding staple fibers and the meltspun fibers to autogenously bond and bind the web structure. After cooling, the solidity of the web was determined and web recovery evaluated. Web samples were evaluated as described in Example 1 with the results given in Table 1.

Example 4

Example 4 was prepared like Example 3 except using non-bondable staple fibers like those used in Example 1. The weight of the staple fiber component in the web was approximately 44 wt % of the total web weight. The total basis weight of the combination web was 382 g/m$^2$. Web samples were evaluated as described in Example 1 with the results given in Table 1.

Example 5

A fibrous web of the invention was prepared using apparatus as shown in FIG. 1 of the drawing, except that the meltblowing die was adapted to prepare bicomponent microfibers and two extruders fed the die to prepare bicomponent meltblown microfibers. One extruder extruded polypropylene at 4.8 kg/hr (Escorene 3505G, available from Exxon Corp.) and the other extruded polyethylene terephthalate glycol (PETG) at 1.6 kg/hr. The PETG forms the sheath of the meltblown fiber and the polypropylene forms the core. The die had a 50.8 cm wide row of 0.38 mm-diameter orifices, and a 66.0 cm wide air knife slot set at 0.762 mm. Staple polyester fiber 6-denier, 3.8 cm, Type 295 available from Kosa was introduced into the fiber stream by lickerin apparatus as pictured in FIG. 1. The drums had a gap of 3.8 cm between them. The distance from the die to surface of the dual-drum collector, where the fibers collect on the dual drum surfaces, was 96.5 cm. A web was collected that contained 65% bicomponent microfibers and 35% staple fibers, with a basis weight of 208 g/m$^2$. Web samples were evaluated as described in Example 1 with the results given in Table 1.

TABLE 1

| Example | 1 | C1 | C2 | 2 | 3 | 4 | 5 |
|---|---|---|---|---|---|---|---|
| Web Basis Weight (g/m2) | 200 | 205 | 410 | 957 | 544 | 382 | 208 |
| Thickness (cm) | 4.0 | 2.8 | 2.1 | 19.6 | 3.2 | 2.9 | 4.0 |
| Initial Solidity (%) | 0.46 | 0.67 | 2.17 | 0.47 | 1.26 | 0.97 | 0.50 |
| Initial Filling Ratio ($cm^3/cm^3$) | 217 | 149 | 46.1 | 212.8 | 79.4 | 103.1 | 200 |
| Recovered Solidity (%) | 0.50 | 0.67 | ND | 0.57 | 1.27 | 1.03 | 0.52 |
| Recovered Filling Ratio | 200 | 149 | ND | 175.4 | 78.7 | 97.1 | 192.3 |
| Thermal Weight Efficiency (clo/kg/$m^2$) | 31.3 | 24.1 | ND | ND | ND | ND | 21.1 |
| Sound Absorption Coefficient (NISAC) | 0.43 | 0.30 | ND | 0.97 | 0.29 | 0.23 | 0.38 |
| Acoustical Specific Air Flow Resistance (mks rayl) | 141 | 325 | ND | ND | ND | ND | ND |
| Transmittance Variability (%) | 0.07 | ND | 2.45 | 0.05 | 0.08 | 0.76 | 0.19 |

As is evident in the results given in Table 1, a web of the invention, as depicted in Example 1, will have lower initial and recovered solidity and improved thermal and noise reduction properties over a web of the same composition and fiber-making method given in Comparative Example 1. Improvement in noise reduction of 43% was attained for the inventive web of Example 1 over Comparative Example 1 of the same composition and fiber production method. Thermal weight efficiency of the inventive web was improved by 30% when compared to a web of equivalent composition made by conventional means. It is additionally evident from the results given in Table 1 that the recovered solidity of all the examples of the invention are at least 80% of their initial solidity, showing that webs of the invention can retain their desired low solidity (and correspondingly high filling ratio) even after compression. The web of Example 5 recovered 99% of its initial solidity after compression. The values of noise reduction coefficient for Examples 1 and 5 when compared to the prior known web of equivalent basis weight and fiber-making process demonstrate improved values of NISAC. Transmittance variability is also seen to be low, being less than 0.1% for Examples 1-3 and less than 0.2% for Example 5.

Figure 8:
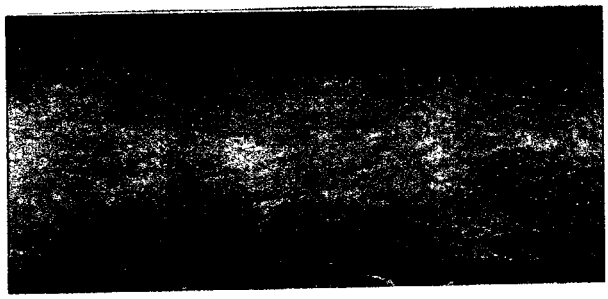
FIGS. 8 and 9 are images prepared while conducting an image analysis technique for characterizing webs, FIG. 8 showing a web of the invention and FIG. 9 showing a web that represents prior-art characteristics.
Figure 9:
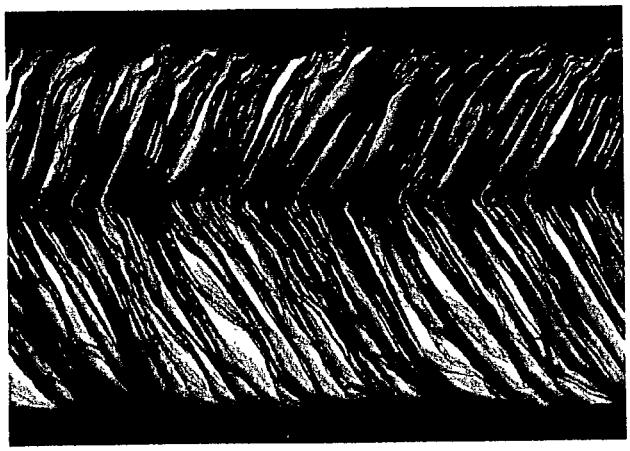

As a further illustration of the image analysis technique, FIG. 8 is an image prepared by the digital camera for a web of Example 5, and FIG. 9 is a similar image of the web of Comparative Example 2.

Figure 10:
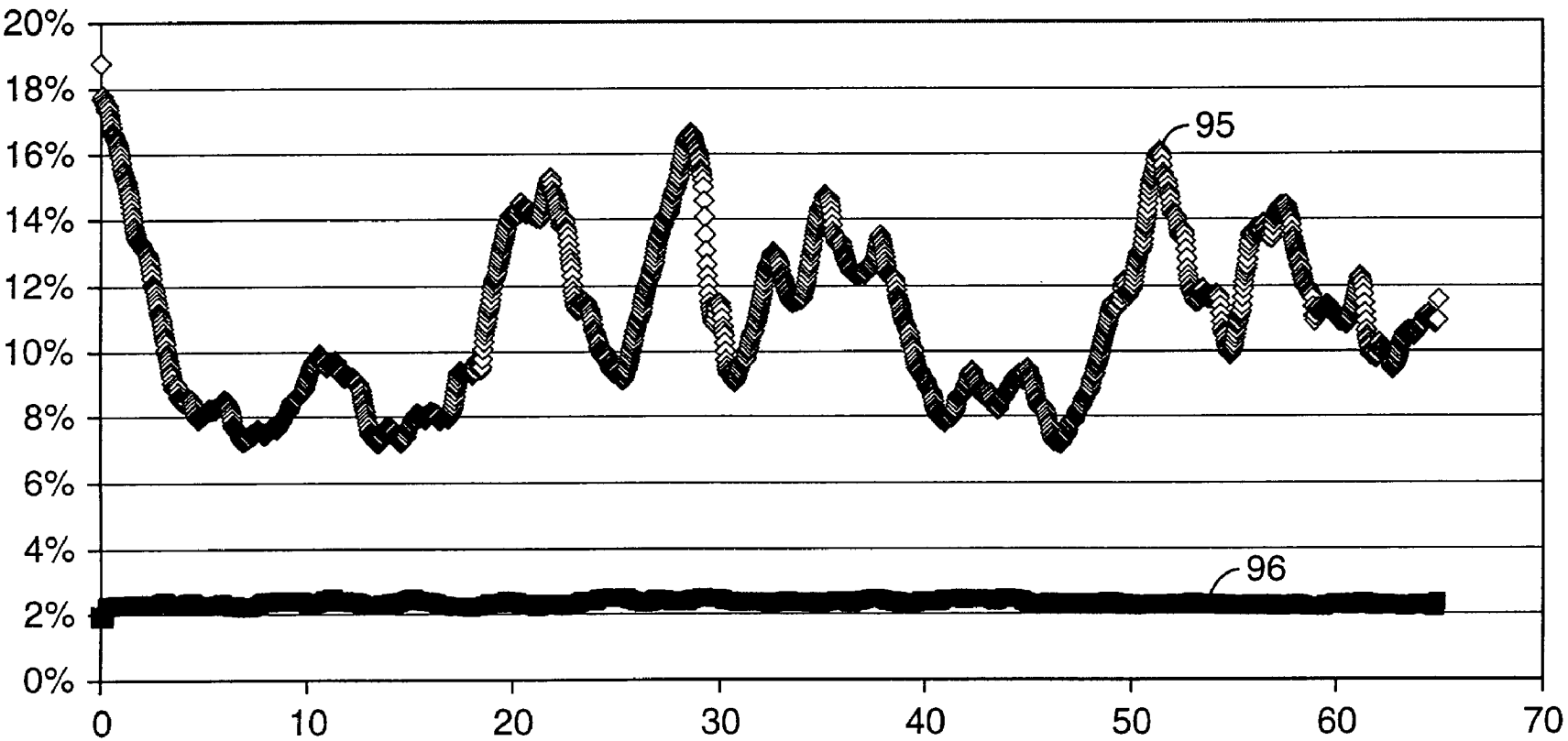
FIG. 10 is a graph plotting results from the noted image analysis technique.

FIG. 10 presents the data points collected in the image analysis technique for a web of Comparative Example 2 (plot 95) and Example 1 (plot 96). Specifically, values of light transmittance, presented as a percentage of the background image (the light received by the image sensor when no web sample was disposed between the light source and the image sensor), are plotted versus position along the y-axis of the sample. The data points are for the z-axis position that showed maximum variability. As seen in FIG. 10, image brightness was substantial and varied widely for the web of Comparative Example 2. But the image brightness was much smaller and much less varied for the web of Example 1. As reported in Table 1, light transmittance variability (the standard deviation for the values plotted in FIG. 10) was 0.07 for the web of Example 1 and 2.45 for the web of Comparative Example 2.

Figure 11:
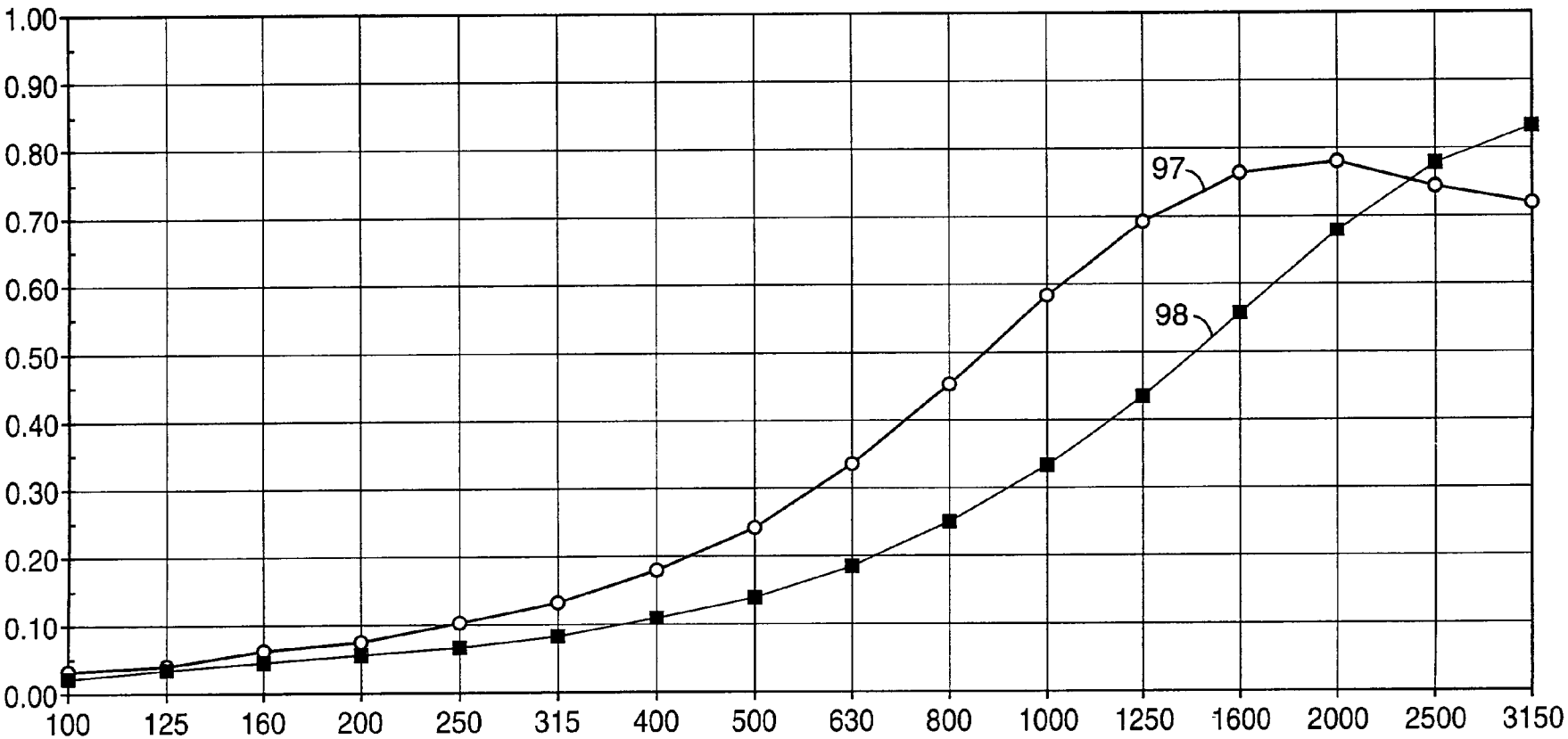
FIG. 11 is a graph plotting values of normal incidence sound absorption coefficient versus frequency for a web of the invention and a comparative web.

Normal incidence sound absorption coefficients for the webs of Example 1 (plot 97) and Comparative Example 1 (plot 98) are plotted in FIG. 11 versus the one-third-octave band frequency in hertz.

What is claimed is:

1. A nonwoven fibrous web comprising a collected mass of directly formed fibers disposed within the web in a C-shaped configuration, and staple fibers having a crimp of at least 15% randomly and thoroughly dispersed among the directly formed fibers in an amount at least 5% the weight of the directly formed fibers to form a continuous, lofty and resilient web structure free of macrovoids.

2. A web of claim 1 having an initial filling ratio of at least 50.

3. A web of claim 1 having an initial filling ratio of at least 75.

4. A web of claim 1 having an initial filling ratio of at least 100.

5. A web of claim I having a light transmittance variation of about 2% or less.

6. A web of claim 1 having a light transmittance variation of about 1% or less.

7. A web of claim 1 having a light transmittance variation of about 0.5% or less.

8. A web of claim 1 in which fibers within the web are bonded together at points of fiber intersection to provide a compression-resistant matrix.

9. A web of claim 8 in which the bonds are autogenous bonds.

10. A web of claim 1 in which the directly formed fibers have an average geometric diameter of about 15 micrometers or less.

11. A web of claim 1 in which the directly formed fibers have an average geometric diameter of about 10 micrometers or less.

12. A web of claim 1 in which the staple fibers are present in an amount at least 10% the weight of the directly formed fibers.

13. A web of claim 1 in which the staple fibers are present in an amount at least 20% the weight of the directly formed fibers.

14. A web of claim 1 in which the directly formed fibers comprise meltblown fibers.

15. A web of claim 1 in which the directly formed fibers comprise polyethylene terephthalate fibers that exhibit a double melting peak on a DSC plot, one peak being representative of a first molecular portion within the fiber that is in non-chain-extended form, and the other peak being representative of a second molecular portion within the fiber that is in chain-extended form and has a melting point elevated over that of the non-chain-extended form.

16. A web of claim 1 in which the directly formed fibers comprise meltspun fibers.

17. A fibrous web of claim 1 having a thickness of at least about 0.5 centimeter, a density of less than about 50 kg/m$^3$, and an acoustical specific airflow resistance of at least 100 mks rayl.

18. A web of claim 1 joined to a supporting sheet.

19. A nonwoven fibrous web comprising a collected mass of directly formed fibers disposed within the web in a C-shaped configuration, and crimped staple fibers having a crimp of at least 15% randomly and thoroughly dispersed among the directly formed fibers in an amount at least 10% the weight of the directly formed fibers to form a continuous, lofty and resilient web structure free of macrovoids, the web having a filling ratio of at least 75 and a light transmittance variation of about 1% or less.

20. A web of claim 19 having a filling ratio of at least 100.

21. A web of claim 19 having a light transmittance variation of about 0.5% or less.

22. A fibrous web of claim 19 in which the directly formed fibers have an average geometric diameter of about 15 micrometers or less.

23. A fibrous web of claim 19 in which the directly formed fibers comprise meltblown microfibers.

24. A fibrous web of claim 19 in which the directly formed fibers comprise molecularly oriented meltspun fibers.

* * * * *

UNITED STATES PATENT AND TRADEMARK OFFICE

CERTIFICATE OF CORRECTION

PATENT NO. : 7,476,632 B2
APPLICATION NO. : 10/295526
DATED : January 13, 2009
INVENTOR(S) : David A. Olson It is certified that error appears in the above-identified patent and that said Letters Patent is hereby corrected as shown below:

Column 24
Line 35, In claim 5, delete "I" insert -- 1 -- , therefor.

Signed and Sealed this

Nineteenth Day of May, 2009

John Doll

JOHN DOLL
*Acting Director of the United States Patent and Trademark Office*